US011233331B2

(12) United States Patent
Nakano et al.

(10) Patent No.: US 11,233,331 B2
(45) Date of Patent: Jan. 25, 2022

(54) ANTENNA DEVICE

(71) Applicant: Panasonic Intellectual Property Management Co., Ltd., Osaka (JP)

(72) Inventors: Kazuya Nakano, Osaka (JP); Yasuharu Matsuoka, Osaka (JP)

(73) Assignee: Pansonic Intellectual Property Management Co., Ltd., Osaka (JP)

( * ) Notice: Subject to any disclaimer, the term of this patent is extended or adjusted under 35 U.S.C. 154(b) by 16 days.

(21) Appl. No.: 16/940,752

(22) Filed: Jul. 28, 2020

(65) Prior Publication Data

US 2020/0358197 A1 Nov. 12, 2020

Related U.S. Application Data

(63) Continuation of application No. PCT/JP2018/048269, filed on Dec. 27, 2018.

(30) Foreign Application Priority Data

Jan. 31, 2018 (JP) ..... JP2018-015528

(51) Int. Cl.
*H01Q 9/42* (2006.01)
*H01Q 5/307* (2015.01)
(Continued)

(52) U.S. Cl.
CPC ..... *H01Q 9/42* (2013.01); *H01Q 1/38* (2013.01); *H01Q 5/307* (2015.01); *H01Q 1/2266* (2013.01)

(58) Field of Classification Search
CPC ..... H01Q 1/38; H01Q 5/364; H01Q 5/321; H01Q 5/378; H01Q 5/307
See application file for complete search history.

(56) References Cited

U.S. PATENT DOCUMENTS

2014/0071000 A1* 3/2014 Tani ..... H01Q 1/243 343/700 MS
2014/0078001 A1* 3/2014 Matsuoka ..... H01Q 5/385 343/700 MS

FOREIGN PATENT DOCUMENTS

JP 6015944 B2 10/2016

OTHER PUBLICATIONS

International Search Report for related Application No. PCT/JP2018/048269, dated Mar. 12, 2019.

* cited by examiner

*Primary Examiner* — Ricardo I Magallanes
(74) *Attorney, Agent, or Firm* — Renner, Otto, Boisselle & Sklar, LLP

(57) ABSTRACT

An antenna device includes a dielectric substrate having a first main surface and a second main surface, a feedpoint provided at a predetermined position of the dielectric substrate, a first radiating element provided on the first main surface and extending from the feedpoint in a predetermined direction, an interlayer connection conductor connected to the first radiating element, a second radiating element provided on the second main surface and extending from the interlayer connection conductor in the predetermined direction, and a third radiating element extending from the feedpoint in the predetermined direction on a path different from a path of the first radiating element. The first radiating element has a U-shaped part that turns away from the feedpoint in a predetermined direction and then turns back and approaches the feedpoint. The third radiating element has a meander-shaped part that meanders by repeatedly approaching and going away from the first radiating element in the plan view.

11 Claims, 30 Drawing Sheets

(51) Int. Cl.
*H01Q 1/38* (2006.01)
*H01Q 1/22* (2006.01)

ANTENNA DEVICE

TECHNICAL FIELD

The present disclosure relates to an antenna device compatible with multiband.

BACKGROUND ART

Antenna devices compatible with a plurality of frequencies have been developed in response to a demand for wireless communication devices operable in multiband (for example, PTL 1).

CITATION LIST

Patent Literature

PTL1: Japanese Patent No. 6015944

SUMMARY

In recent years, there has been an increasing demand for antenna devices that are both small and operable in multiband. The present disclosure provides an antenna device that are both small and operable in multiband.

An antenna device according to one aspect of the present disclosure includes a dielectric substrate having a first main surface and a second main surface opposite to the first main surface, a feedpoint provided at a predetermined position of the dielectric substrate, a first radiating element provided on the first main surface and extending from the feedpoint in a predetermined direction, an interlayer connection conductor penetrating the dielectric substrate and connected to the first radiating element, a second radiating element provided on the second main surface and extending from the interlayer connection conductor in the predetermined direction, and a third radiating element provided on any one of the first main surface or the second main surface and extending from the feedpoint in the predetermined direction on a path different from a path of the first radiating element. The first radiating element has a U-shaped part that goes away from the feedpoint in a predetermined direction and then turns back and approaches the feedpoint. The interlayer connection conductor is connected to an end of a part after where the U-shaped part turns back on a side closer to the feedpoint. The second radiating element has a meander-shaped part that overlaps the U-shaped part in plan view of the dielectric substrate. The third radiating element has a meander-shaped part that meanders by repeatedly approaching and going away from the first radiating element in the plan view.

The antenna device of the present disclosure can be both small and operable in multiband.

DESCRIPTION OF EMBODIMENTS

Figure 1A:
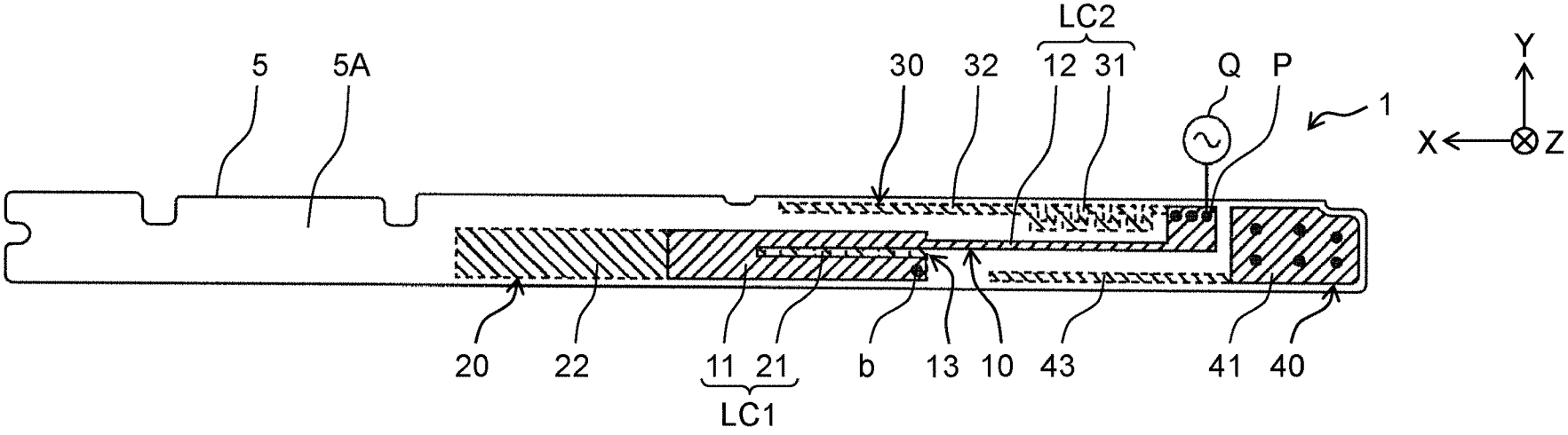
FIG. 1A is a plan perspective view of an antenna device according to an exemplary embodiment as viewed from a first main surface.

An antenna device of the present disclosure includes a dielectric substrate having a first main surface and a second main surface opposite to the first main surface, a feedpoint provided at a predetermined position of the dielectric substrate, a first radiating element provided on the first main surface and extending from the feedpoint in a predetermined direction, an interlayer connection conductor formed to penetrate the dielectric substrate and connected to the first radiating element, a second radiating element provided on the second main surface and extending from the interlayer connection conductor in the predetermined direction, and a third radiating element provided on any one of the first main surface or the second main surface and extending from the feedpoint in the predetermined direction on a path different from a path of the first radiating element. The first radiating element has a U-shaped part that goes away from the feedpoint in a predetermined direction and then turns back and approaches the feedpoint. The interlayer connection conductor is connected to an end of a part after where the U-shaped part turns back on a side closer to the feedpoint. The second radiating element has a meander-shaped part that overlaps the U-shaped part in plan view of the dielectric substrate. The third radiating element has a meander-shaped part that meanders by repeatedly approaching and going away from the first radiating element in the plan view.

Accordingly, when the first radiating element is designed to have the same electrical length with or without the U-shaped part, the first radiating element with the U-shaped part has a shorter length in the predetermined direction, which can be smaller (which can prevent a thin and long formation, for example). Further, when the second radiating element is designed to have the same electrical length with or without the meander-shaped part, the second radiating element with the meander-shaped part can efficiently utilize the space and can be smaller by meandering the conductor patterns and the like. The third radiating element, which also has the meander-shaped part, can be also smaller.

Further, the antenna device of the present disclosure has a plurality of resonance frequencies. Specifically, the following parts (i) to (v) resonate at different frequencies. Part (i) is a part from the feedpoint through the first radiating element and the interlayer connection conductor to an end of the second radiating element on a side opposite to the interlayer connection conductor in the predetermined direction. Part (ii) is a first LC resonator configured by capacitively coupling the meander-shaped part of the second radiating element and the U-shaped part. Part (iii) is a part from the feedpoint to an end of the third radiating element on a side opposite to the feedpoint in the predetermined direction. Part (iv) is a part from the feedpoint to the end of the part after where the U-shaped part turns back on a side closer to the feedpoint. Part (v) is a second LC resonator configured by capacitively coupling the meander-shaped part of the third radiating element and the first radiating element. This enables the antenna device to be compatible with a plurality of frequencies and to be operable in multibanded.

At this time, part (ii) and part (iv) commonly include the U-shaped part. However, with a part commonly included in this way, adjusting a resonance frequency of one (for example, part (iv)) will change the electrical length of the other (for example, part (ii)) and also change a resonance frequency of the other. That is, for example, it is considered difficult to set the resonance frequencies of both part (ii) and part (iv) to desired frequencies. However, in the present disclosure, by adjusting the length of a slit located between the parts before and after where U-shaped part turns back from a U-shaped open end to a closed end in the predetermined direction, the resonance frequency of part (iv) can be adjusted to the desired frequency while a fluctuation of the resonance frequency of part (ii) is suppressed. Therefore, the resonance frequencies of both part (ii) and part (iv) can be set to the desired frequencies.

Similarly, part (iii) and part (v) commonly include the meander-shaped part, it is considered difficult to set the resonance frequencies of both part (iii) and part (v) to desired frequencies. However, in the present disclosure, by adjusting the distance between the meander-shaped part and the first radiating element, the resonance frequency of part (v) can be adjusted to a desired frequency while a fluctuation of the resonance frequency of part (iii) is suppressed. Thus, the resonance frequencies of both part (iii) and part (v) can be set to the desired frequencies. In this way, the plurality of compatible frequencies can be set to the desired frequencies.

As described above, the present disclosure can provide devices that are both small and operable in multiband.

Further, the third radiating element may be provided on the second main surface. Accordingly, the third radiating element and the first radiating element can face each other on the first main surface and the second main surface of the dielectric substrate, respectively. This makes it easy to capacitively couple the meander-shaped part of the third radiating element and the first radiating element.

The meander-shaped part of the second radiating element and the U-shaped part may be capacitively coupled to configure a first LC resonator, the meander-shaped part of the third radiating element and the first radiating element may be capacitively coupled to configure a second LC resonator, a part from the feedpoint through the first radiating element and the interlayer connection conductor to an end of the second radiating element on a side opposite to the interlayer connection conductor in the predetermined direction may resonate at a first frequency, the first LC resonator may resonate at a second frequency higher than the first frequency, a part from the feedpoint to an end of the third radiating element on the side opposite to the feedpoint in the predetermined direction may resonate at a third frequency higher than the second frequency, a part from the feedpoint to the end of the part after where the U-shaped part turns back on the side closer to the feedpoint may resonate at a fourth frequency higher than the third frequency, and the second LC resonator may resonate at a fifth frequency higher than the fourth frequency.

In this way, the antenna device is compatible with different frequencies of the first to fifth frequencies.

Further, the first frequency may be a frequency according to a length of the second radiating element from the interlayer connection conductor in the predetermined direction. The second frequency may be a frequency according to a length of the first radiating element from the feedpoint in the predetermined direction. The third frequency may be a frequency according to a length of the third radiating element from the feedpoint in the predetermined direction. The fourth frequency may be a frequency corresponding to the length of the slit located between the parts before and after where the U-shaped part turns back, from the U-shaped open end in the predetermined direction. The fifth frequency may be a frequency corresponding to a distance between the meander-shaped part of the third radiating element and the first radiating element. Accordingly, the first to fifth frequencies can be adjusted to desired frequencies.

The antenna device may further include a passive element that is provided on at least one of the first main surface or the second main surface and is fed with no signal from the feedpoint. The passive element does not need to overlap any of the first radiating element, the second radiating element, or the third radiating element in the plan view. Further, the passive element may resonate at a sixth frequency higher than the third frequency and lower than the fourth frequency. Accordingly, the antenna device is also compatible with the sixth frequency.

Further, the passive element extends in the predetermined direction, and the sixth frequency may be a frequency according to a length of the passive element in the predetermined direction. Accordingly, the sixth frequency can be adjusted to a desired frequency.

Hereinafter, an exemplary embodiment will be described in detail with reference to the drawings accordingly. However, an unnecessarily detailed description may be omitted. For example, a detailed description of a well-known item or a redundant description of substantially the same configuration may be omitted. This is to prevent the following description from being unnecessarily redundant and to facilitate understanding by those skilled in the art.

The inventors provide the accompanying drawings and the following description in order for those skilled in the art to fully understand the present disclosure, and do not intend to limit the subject matter described in the appended claims by the accompanying drawings and the following description.

Exemplary Embodiment

The exemplary embodiment will be described below with reference to FIGS. 1A to 15.

First, the overall configuration of an antenna device according to the exemplary embodiment will be described with reference to FIGS. 1A to 1C.

Figure 1B:
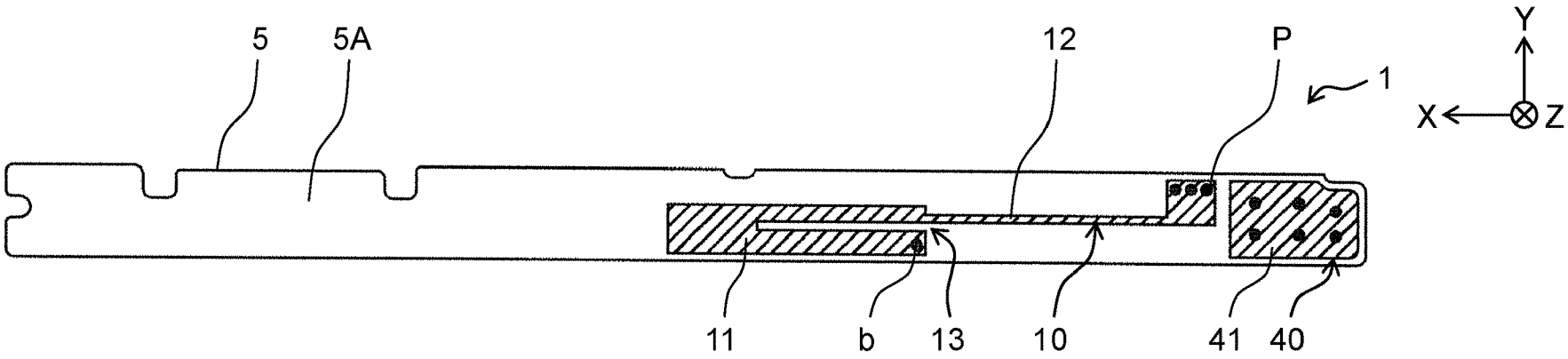
FIG. 1B is a plan view of the antenna device according to the exemplary embodiment as viewed from the first main surface.
Figure 1C:
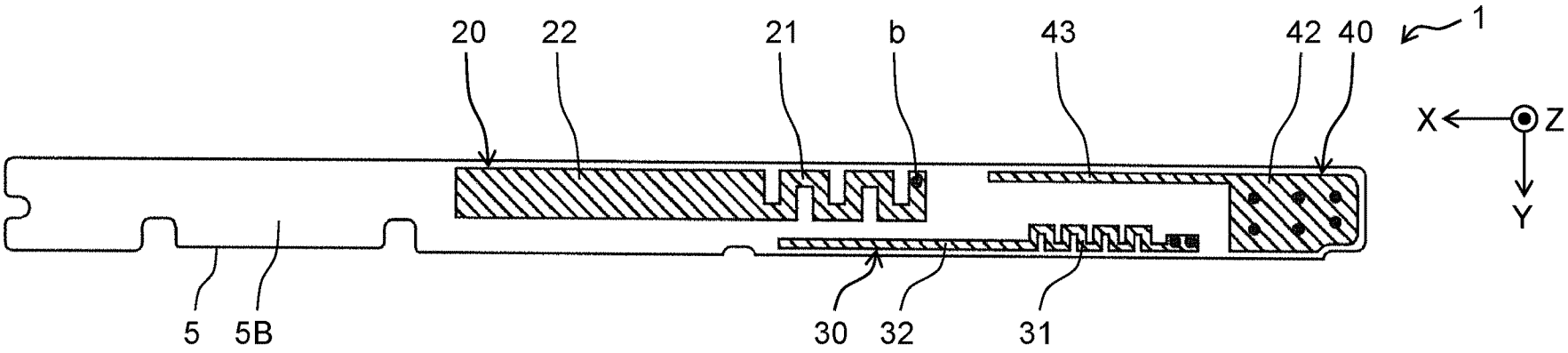
FIG. 1C is a plan view of the antenna device according to the exemplary embodiment as viewed from a second main surface.

FIG. 1A is a plan perspective view of antenna device 1 according to an exemplary embodiment as viewed from first main surface 5A. FIG. 1B is a plan view of antenna device 1 according to the exemplary embodiment as viewed from first main surface 5A. FIG. 1C is a plan view of antenna device 1 according to the exemplary embodiment as viewed from second main surface 5B. In FIG. 1A which is a diagram viewed from first main surface 5A (front surface), conductor patterns and the like provided on second main surface 5B (rear surface) are indicated by broken lines.

Antenna device 1 includes a dielectric substrate 5, feedpoint P, first radiating element 10, interlayer connection conductor b, second radiating element 20, third radiating element 30, antenna GND 40, and passive element 43.

Dielectric substrate 5 is, for example, a printed wiring board having first main surface 5A and second main surface 5B facing first main surface 5A, and a double-sided substrate provided with conductor patterns on both first main surface 5A and second main surface 5B. Dielectric substrate 5 has, for example, an elongated shape in which a predetermined direction (here, an x-axis direction) is a longitudinal direction and a y-axis direction is a lateral direction. The shape of dielectric substrate 5 is not limited to an elongated shape, and may be appropriately determined in accordance with a place where antenna device 1 is disposed or the like.

Feedpoint P is provided at a predetermined position on dielectric substrate 5. For example, feedpoint P is provided near a minus side end of dielectric substrate 5 in the x-axis direction. Feedpoint P is connected to signal source Q such as a wireless communication circuit. In the drawings described below, signal source Q may be omitted. A position where feedpoint P is provided is not limited to near the minus side end of dielectric substrate 5 in the x-axis direction, but is appropriately determined in accordance with the shape of dielectric substrate 5 or the like.

First radiating element 10 is provided on first main surface 5A, is connected to feedpoint P, and extends from feedpoint P in the predetermined direction (x-axis direction). Specifically, first radiating element 10 has linear part 12 extending from feedpoint P to a plus side in the x-axis direction and U-shaped part 11 connected to the plus side of linear part 12 in the x-axis direction and extending in the x-axis direction. U-shaped part 11 is formed to turn back after going away from feedpoint P in the x-axis direction (that is, after extending to the plus side in the x-axis direction), and then approach feedpoint P (that is, extends to the minus side in the x-axis direction). Slit 13 is located between parts before and after where U-shaped part 11 turns back. An open end of U-shaped part 11 is on the minus side in the x-axis direction of U-shaped part 11. Slit 13 is provided from the open end toward the plus side in the x-axis direction to a closed end.

The interlayer connection conductor b is formed to penetrate dielectric substrate 5, and is connected to first radiating element 10. Specifically, the interlayer connection conductor b is connected to an end of the part after where U-shaped part 11 turns back on a side closer to feedpoint P (end of the part after where U-shaped part turns back on the minus side in the x-axis direction). The interlayer connection conductor b is connected to an end of meander-shaped part 21 of second radiating element 20, which will be described later, on the minus side in the x-axis direction. Although indicated by dots without a reference mark, antenna device 1 is provided with an interlayer connection conductor connecting first radiating element 10 and third radiating element 30 near feedpoint P, and an interlayer connection conductor connecting first part 41 on first main surface 5A and second part 42 on second main surface 5B that configure antenna GND 40. Note that interlayer connection conductors other than the interlayer connection conductors shown in the drawings may be provided.

Second radiating element 20 is provided on second main surface 5B and extends from interlayer connection conductor b in the predetermined direction (x-axis direction). Specifically, second radiating element 20 has meander-shaped part 21 extending from interlayer connection conductor b to the plus side in the x-axis direction, and linear part 22 connected to a plus side end of meander-shaped part 21 in the x-axis direction and extending to the plus side in the x-axis direction. Meander-shaped part 21 overlaps U-shaped part 11 of first radiating element 10 in the plan view of dielectric substrate 5. Meander-shaped part 21 meanders by repeatedly going toward the plus side in the y-axis direction and going toward the minus side in the y-axis direction to be formed in a meander shape. Meander-shaped part 21 and U-shaped part 11 are capacitively coupled to each other to configure first LC resonator LC1.

Third radiating element 30 is provided on any one of first main surface 5A or second main surface 5B, and extends in the predetermined direction (x-axis direction) from feedpoint P on a path different from a path of first radiating element 10. In the present exemplary embodiment, third radiating element 30 is provided on second main surface 5B so as to be on a path different from a path of first radiating element 10 provided on first main surface 5A (such that a path through which a current flows is different from a path of first radiating element 10). Third radiating element 30 has meander-shaped part 31 extending from the interlayer connection conductor connected to first radiating element 10 and provided near feedpoint P to the plus side in the x-axis direction, and linear part 32 connected to a plus side end of meander-shaped part 31 in the x-axis direction and extending to the plus side in the x-axis direction. Meander-shaped part 31 meanders by repeatedly approaching first radiating element 10 (that is, going toward the minus side in the y-axis direction) and going away from first radiating element 10 (that is, going toward the plus side in the y-axis direction) in the plan view of dielectric substrate 5 to be formed in a meander shape. Meander-shaped part 31 and linear part 12 of first radiating element 10 are capacitively coupled to configure second LC resonator LC2.

Antenna GND 40 is a ground pattern that is grounded to a metal part of a housing provided with antenna device 1. In the present exemplary embodiment, antenna GND 40 is configured by first part 41 provided on first main surface 5A and second part 42 provided on second main surface 5B. First part 41 and second part 42 are provided at the end of dielectric substrate 5 on the minus side in the x-axis direction so as to overlap each other in the plan view of dielectric substrate 5. As described above, first part 41 and second part 42 are connected by the interlayer connection conductor.

Passive element 43 is provided on at least one of first main surface 5A or second main surface 5B and is fed with no signal from feedpoint P. In the present exemplary embodiment, passive element 43 is provided on second main surface 5B. Passive element 43 is connected to the end of second part 42 of antenna GND 40 on the plus side in the x-axis direction and on the minus side in the y-axis direction and extends to the plus side in the x-axis direction. Passive element 43 does not overlap with any of first radiating element 10, second radiating element 20, or third radiating element 30 in the plan view of dielectric substrate 5. Further, passive element 43 is not connected to any of first radiating element 10, second radiating element 20, or third radiating element 30.

Various conductors formed on dielectric substrate 5 (first radiating element 10, interlayer connection conductor, second radiating element 20, third radiating element 30, antenna GND 40, passive element 43, and the like) use, for example, Al, Cu, Au, Ag, or a metal including an alloy thereof as a main component.

Next, the overall configuration of antenna device 2 according to a comparative example will be described with reference to FIGS. 2A to 2C.

Figure 2A:
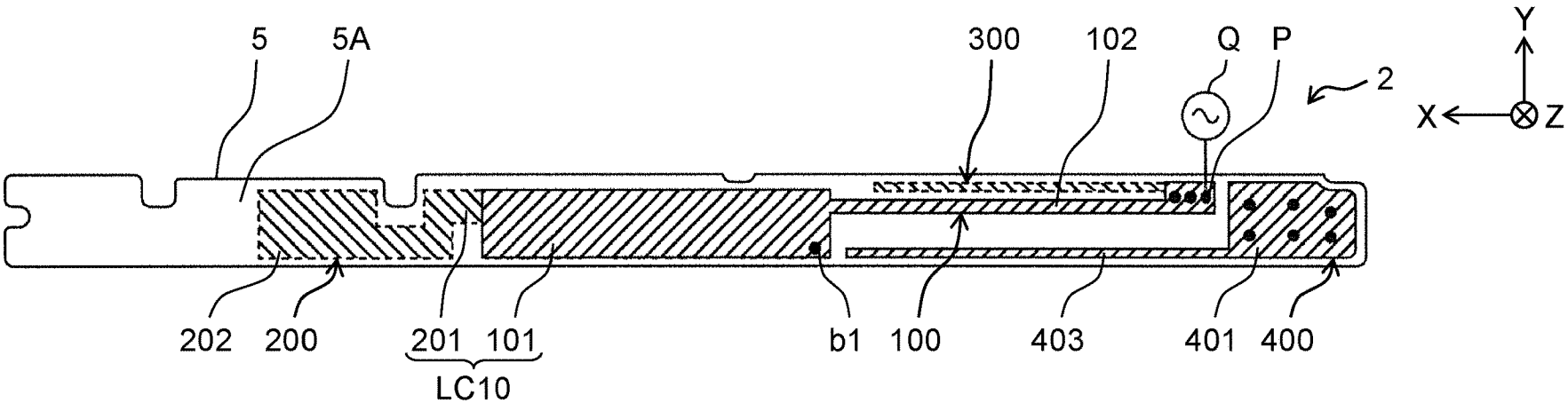
FIG. 2A is a plan perspective view of an antenna device according to a comparative example as viewed from the first main surface.
Figure 2B:
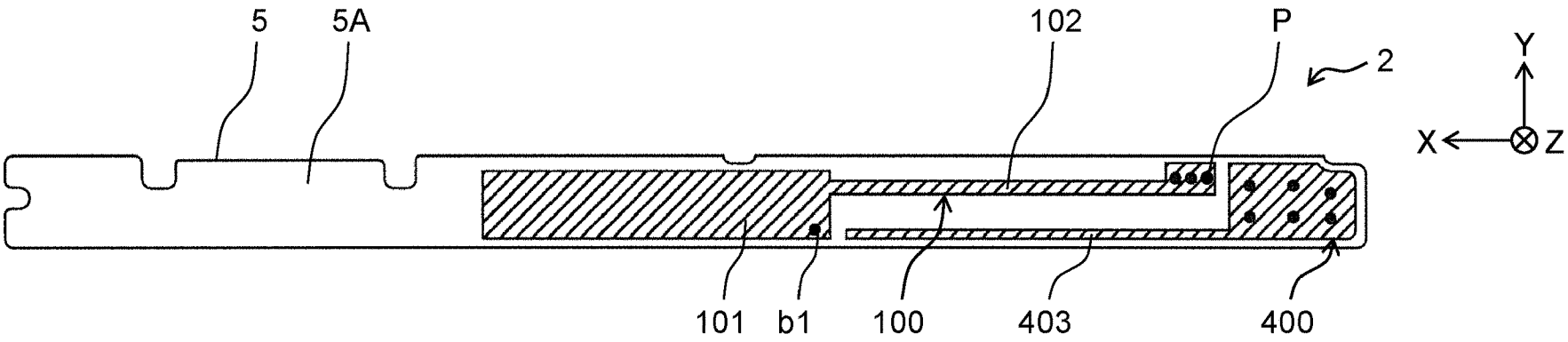
FIG. 2B is a plan view of the antenna device according to the comparative example as viewed from the first main surface.
Figure 2C:
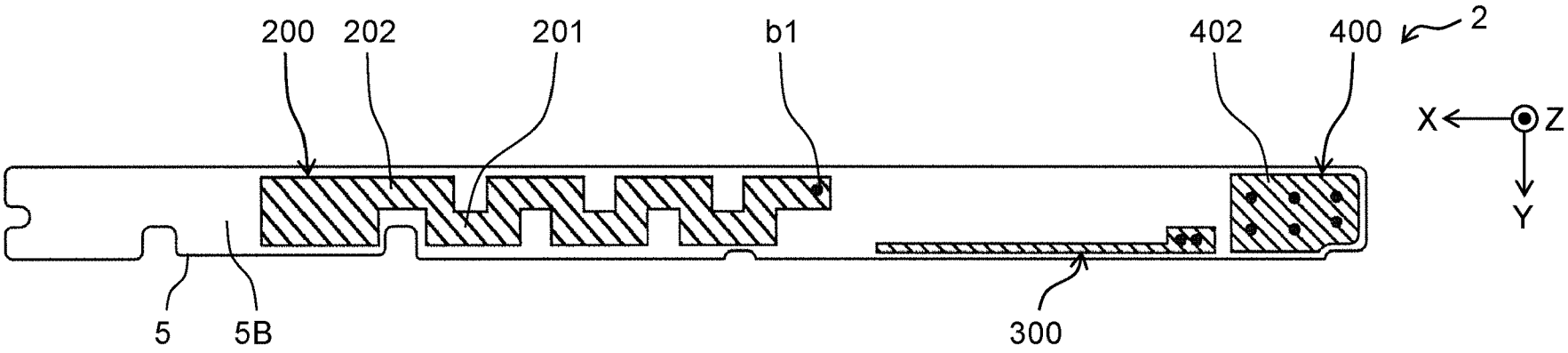
FIG. 2C is a plan view of the antenna device according to the comparative example as viewed from the second main surface.

FIG. 2A is a plan perspective view of antenna device 2 according to the comparative example as viewed from first main surface 5A. FIG. 2B is a plan view of antenna device 2 according to the comparative example as viewed from first main surface 5A. FIG. 2C is a plan view of antenna device 2 according to the comparative example as viewed from second main surface 5B. In FIG. 2A which is a diagram viewed from first main surface 5A (front surface), conductor patterns and the like provided on second main surface 5B (rear surface) are indicated by broken lines.

Antenna device 2 includes dielectric substrate 5, feedpoint P, first radiating element 100, interlayer connection conductor b1, second radiating element 200, third radiating element 300, antenna GND 400, and passive element 403.

Dielectric substrate 5 and feedpoint P are the same as those included in antenna device 1 according to the exemplary embodiment, and thus description thereof will be omitted.

First radiating element 100 is provided on first main surface 5A, is connected to feedpoint P, and extends from feedpoint P in the x-axis direction. Specifically, first radiating element 100 has linear part 102 extending from feedpoint P to the plus side in the x-axis direction and linear part 101 connected to a plus side end of linear part 102 in the x-axis direction and extending in the x-axis direction. Linear part 101 is longer than linear part 102 in the y-axis direction.

Interlayer connection conductor b1 is formed to penetrate dielectric substrate 5, and is connected to first radiating element 100. Specifically, interlayer connection conductor b1 is connected to the end of linear part 101 on a side closer to feedpoint P (end of linear part 101 on the minus side in the x-axis direction and the minus side in the y-axis direction). The interlayer connection conductor b1 is connected to an end of meander-shaped part 201 of second radiating element 200, which will be described later, on the minus side in the x-axis direction. Although indicated by dots without a reference mark, antenna device 2 is provided with an interlayer connection conductor connecting first radiating element 100 and third radiating element 300 near feedpoint P, and an interlayer connection conductor connecting first part 401 on first main surface 5A and second part 402 on second main surface 5B that configure antenna GND 400. Note that interlayer connection conductors other than the interlayer connection conductors shown in the drawings may be provided.

Second radiating element 200 is provided on second main surface 5B and extends from interlayer connection conductor b1 in the x-axis direction. Specifically, second radiating element 200 has meander-shaped part 201 extending from interlayer connection conductor b1 to the plus side in the x-axis direction, and linear part 202 connected to a plus side end of meander-shaped part 201 in the x-axis direction and extending to the plus side in the x-axis direction. Meander-shaped part 201 overlaps linear part 101 of first radiating element 100 in the plan view of dielectric substrate 5. Meander-shaped part 201 meanders by repeatedly going toward the plus side in the y-axis direction and going toward the minus side in the y-axis direction to be formed in a meander shape. Meander-shaped part 201 and linear part 101 are capacitively coupled to each other to configure LC resonator LC10.

Third radiating element 300 is provided on second main surface 5B and extends in the x-axis direction from feedpoint P on a path different from a path of first radiating element 100. Third radiating element 300 is provided near feedpoint P and linearly extends from the interlayer connection conductor connected to first radiating element 100 to the plus side in the x-axis direction.

Antenna GND 400 is a ground pattern that is grounded to the metal part of the housing provided with antenna device 2. Antenna GND 400 is configured by first part 401 provided on first main surface 5A and second part 402 provided on second main surface 5B. First part 401 and second part 402 are provided near the end of dielectric substrate 5 on the minus side in the x-axis direction so as to overlap each other in the plan view of dielectric substrate 5. As described above, first part 401 and second part 402 are connected by the interlayer connection conductor.

Passive element 403 is provided on first main surface 5A. Passive element 403 is connected to the end of first part 401 of antenna GND 400 on the plus side in the x-axis direction and on the minus side in the y-axis direction and extends to the plus side in the x-axis direction. Passive element 403 does not overlap with any of first radiating element 100, second radiating element 200, or third radiating element 300 in the plan view of dielectric substrate 5. Further, passive element 403 is not connected to any of first radiating element 100, second radiating element 200, or third radiating element 300.

The following will describe frequencies with which antenna device 1 according to the exemplary embodiment and antenna device 2 according to the comparative example are compatible.

Figure 3:
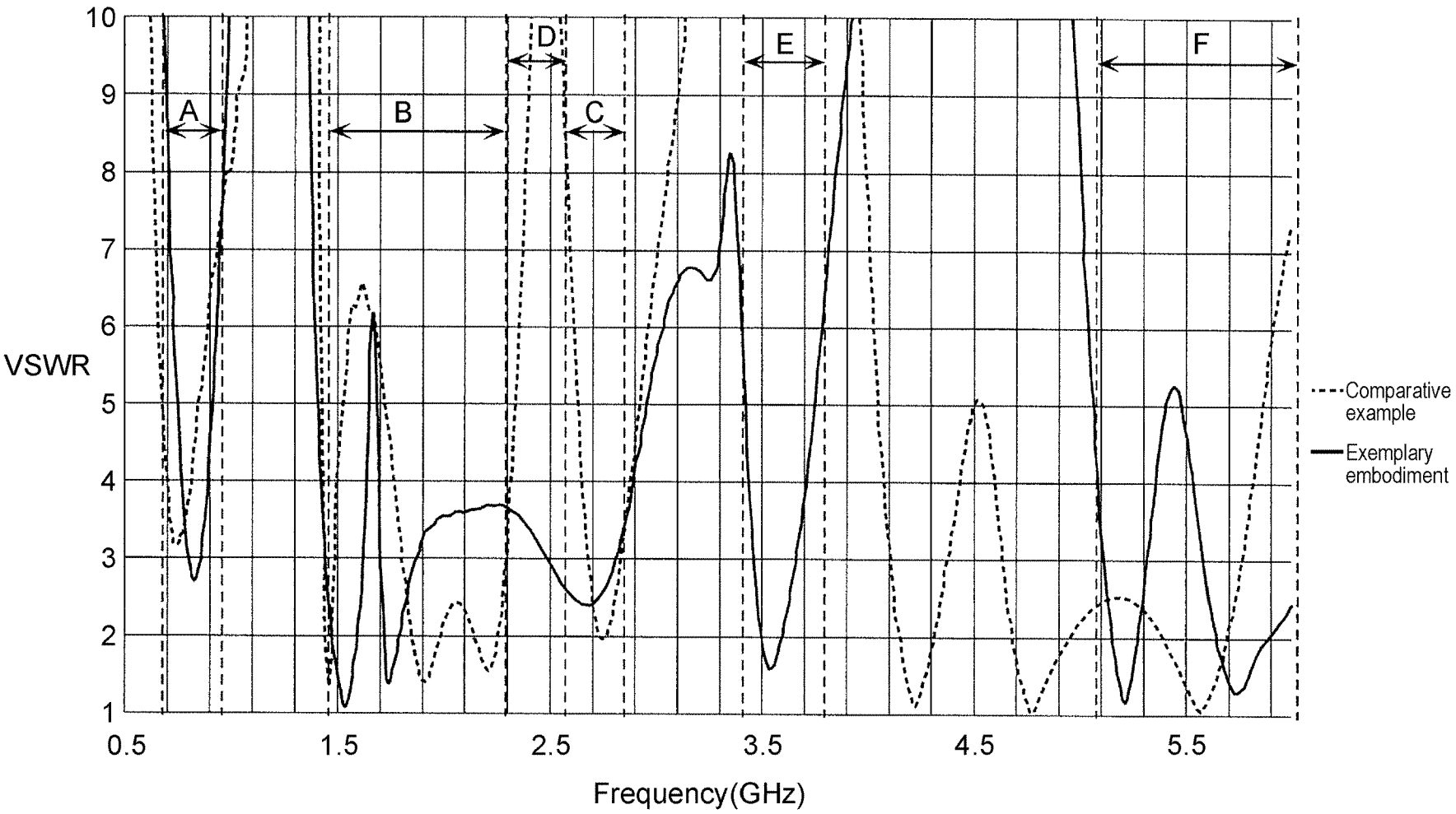
FIG. 3 is a graph showing frequency characteristics of voltage standing wave ratios of the antenna device according to the exemplary embodiment and the antenna device according to the comparative example.

FIG. 3 is a graph showing frequency characteristics of voltage standing wave ratios (voltage standing wave ratios (VSWRs)) of antenna device 1 according to the exemplary embodiment and antenna device 2 according to the comparative example. The VSWR of antenna device 2 according to the comparative example is shown by a broken line, and the VSWR of antenna device 1 according to the exemplary embodiment is shown by a solid line.

As shown in FIG. 3, antenna device 2 according to the comparative example is compatible with the frequency bands of parts A, B, and C in FIG. 3.

However, in recent years, it is necessary to be compatible with the fourth generation mobile communication system (4G), the third generation mobile communication system (3G), and the like. One antenna should cover more and more frequency bands. In this trend, antenna device 1 according to the present exemplary embodiment is not only compatible with the frequency bands of parts A, B, and C in FIG. 3, but also compatible with the frequency bands of parts D, E, and F. Antenna device 1 according to the present exemplary embodiment is thus compatible with more frequency bands than antenna device 2 according to the comparative example.

Furthermore, antenna device 1 according to the exemplary embodiment can be smaller than antenna device 2 according to the comparative example. Specifically, when first radiating element 10 is designed to have the same electrical length with or without U-shaped part 11, first radiating element 10 with U-shaped part 11 has a shorter length in the x-axis direction, which can be smaller (which can prevent a thin and long formation, for example). Further, when second radiating element 20 is designed to have the same electrical length with or without meander-shaped part 21, second radiating element 20 with meander-shaped part 21 can efficiently utilize the space and can be smaller by meandering the conductor patterns and the like. Third radiating element 30, which has meander-shaped part 31, can be also similarly smaller.

As described above, antenna device 1 of the present disclosure can be both small and operable in multiband.

Hereinafter, frequencies around 0.8 GHz (part A in FIG. 3) are referred to as a first frequency, frequencies around 1.4 GHz (part B in FIG. 3) are referred to as a second frequency, frequencies around 1.7 GHz (part B in FIG. 3) are referred to as a third frequency, frequencies around 2.6 GHz (parts C and D in FIG. 3) are referred to as a sixth frequency, frequencies around 3.5 GHz (part E in FIG. 3) are referred to as a fourth frequency, and frequencies around 5 GHz (part F in FIG. 3) are referred to as a fifth frequency.

A part from feedpoint P through first radiating element 10 and interlayer connection conductor b to the end of second radiating element 20 on the side opposite to interlayer connection conductor b in the x-axis direction (plus side end in the x-axis direction) resonates at the first frequency. The electrical length of this part can be changed in accordance with a length of second radiating element 20 from interlayer connection conductor b in the x-axis direction. Thus, the first frequency becomes a frequency according to the length of second radiating element 20 from interlayer connection conductor b in the x-axis direction.

First LC resonator LC1 resonates at the second frequency higher than the first frequency. An LC component of first LC resonator LC1 can be changed by an overlapping amount of first radiating element 10 and second radiating element 20 in the plan view of dielectric substrate 5. That is, the LC component of first LC resonator LC1 can be changed in accordance with the length of first radiating element 10 from feedpoint P in the x-axis direction. Thus, the second frequency becomes a frequency according to the length of first radiating element 10 from feedpoint P in the x-axis direction.

A part from feedpoint P to the end of third radiating element 30 on the opposite side of feedpoint P in the x-axis direction (plus side end in the x-axis direction) resonates at the third frequency higher than the second frequency. The electrical length of this part can be changed in accordance with a length of third radiating element 30 from feedpoint P in the x-axis direction. Thus, the third frequency becomes a frequency according to the length of third radiating element 30 from feedpoint P in the x-axis direction.

The part from feedpoint P to the end of the part after where U-shaped part 11 turns back on a side closer to feedpoint P (end on the minus side in the x-axis direction) resonates at the fourth frequency higher than the third frequency. The electrical length of this part can be changed in accordance with a length of slit 13 located between the parts before and after where U-shaped part 11 turns back, from the U-shaped open end in the x-axis direction. Thus, the fourth frequency becomes a frequency according to the length of slit 13 from the U-shaped open end in the x-axis direction.

Second LC resonator LC2 resonates at the fifth frequency higher than the fourth frequency. An LC component of second LC resonator LC2 can be changed in accordance with a distance between meander-shaped part 31 of third radiating element 30 and first radiating element 10. Thus, the fifth frequency becomes a frequency according to the distance between meander-shaped part 31 and first radiating element 10.

Passive element 43 resonates at the sixth frequency higher than the third frequency and lower than the fourth frequency. Passive element 43 extends in the x-axis direction, and the sixth frequency is a frequency according to the length of passive element 43 in the x-axis direction.

In the exemplary embodiment, the part that resonates at the second frequency and the part that resonates at the fourth frequency commonly include U-shaped part 11. However, with a part commonly included in this way, adjusting a resonance frequency of one (for example, the part that resonates at the fourth frequency) is considered to change the electrical length of the other (for example, the part that resonates at the second frequency) and also change a resonance frequency of the other. However, in the present disclosure, by adjusting the length of slit 13 located between the parts before and after where U-shaped part 11 turns back from the U-shaped open end in the x-axis direction, the resonance frequency of the part resonating at the fourth frequency can be adjusted to a desired frequency while a fluctuation of the resonance frequency of the part resonating at the second frequency is suppressed. This will be described with reference to FIGS. 4A to 5B.

Figure 4A:
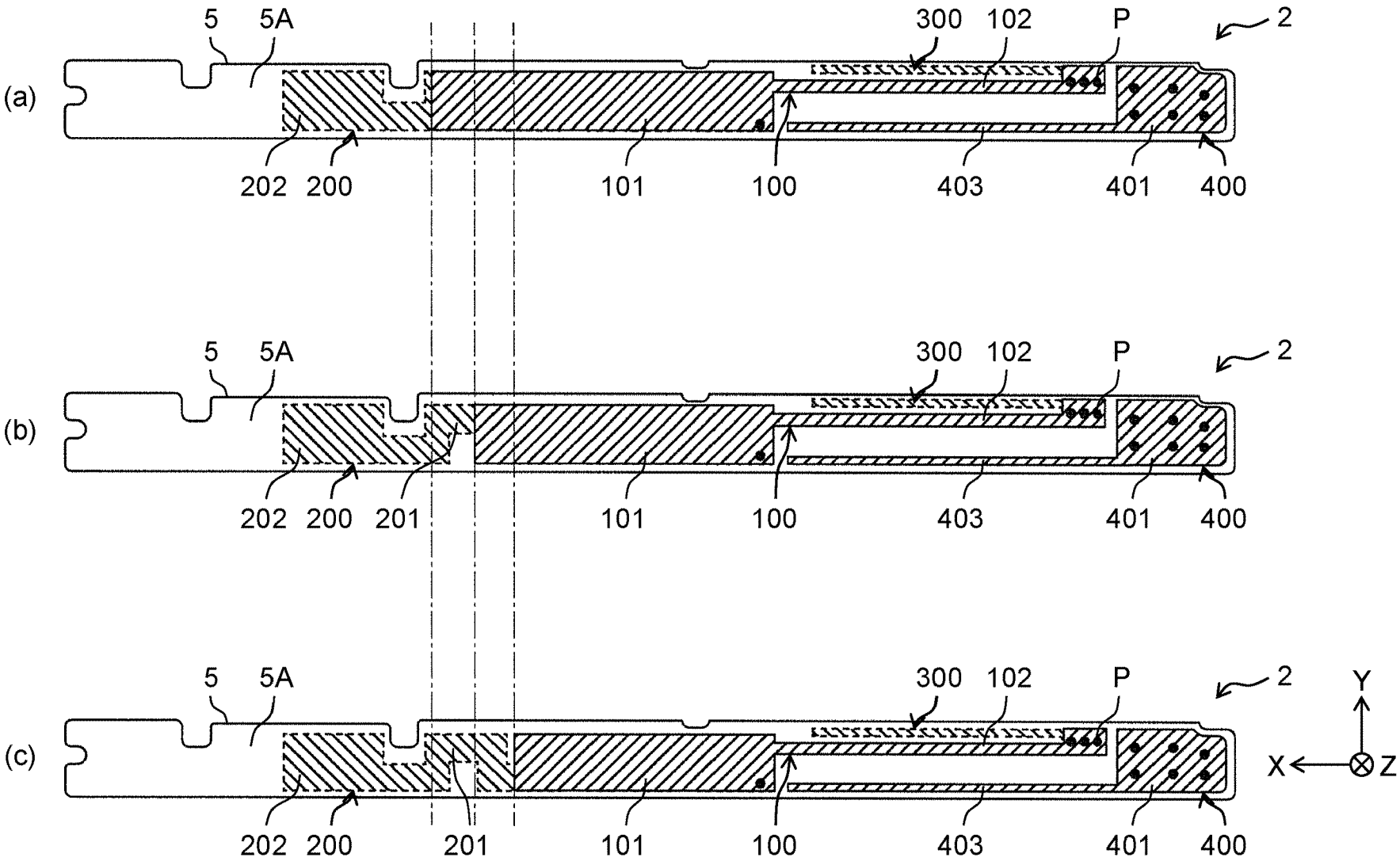
FIG. 4A is a diagram for explaining one example of a conventional method of adjusting a frequency.

FIG. 4A is a diagram for explaining one example of a conventional method of adjusting a frequency. In FIG. 4A, one example of a conventional method of adjusting a frequency will be described using antenna device 2 according to the comparative example. The length of linear part 101 of first radiating element 100 in the x-axis direction is different in parts (a) to (c) of FIG. 4A. The length in part (a) of FIG. 4A is the longest, and the length in part (c) of FIG. 4A is the shortest.

Figure 4B:
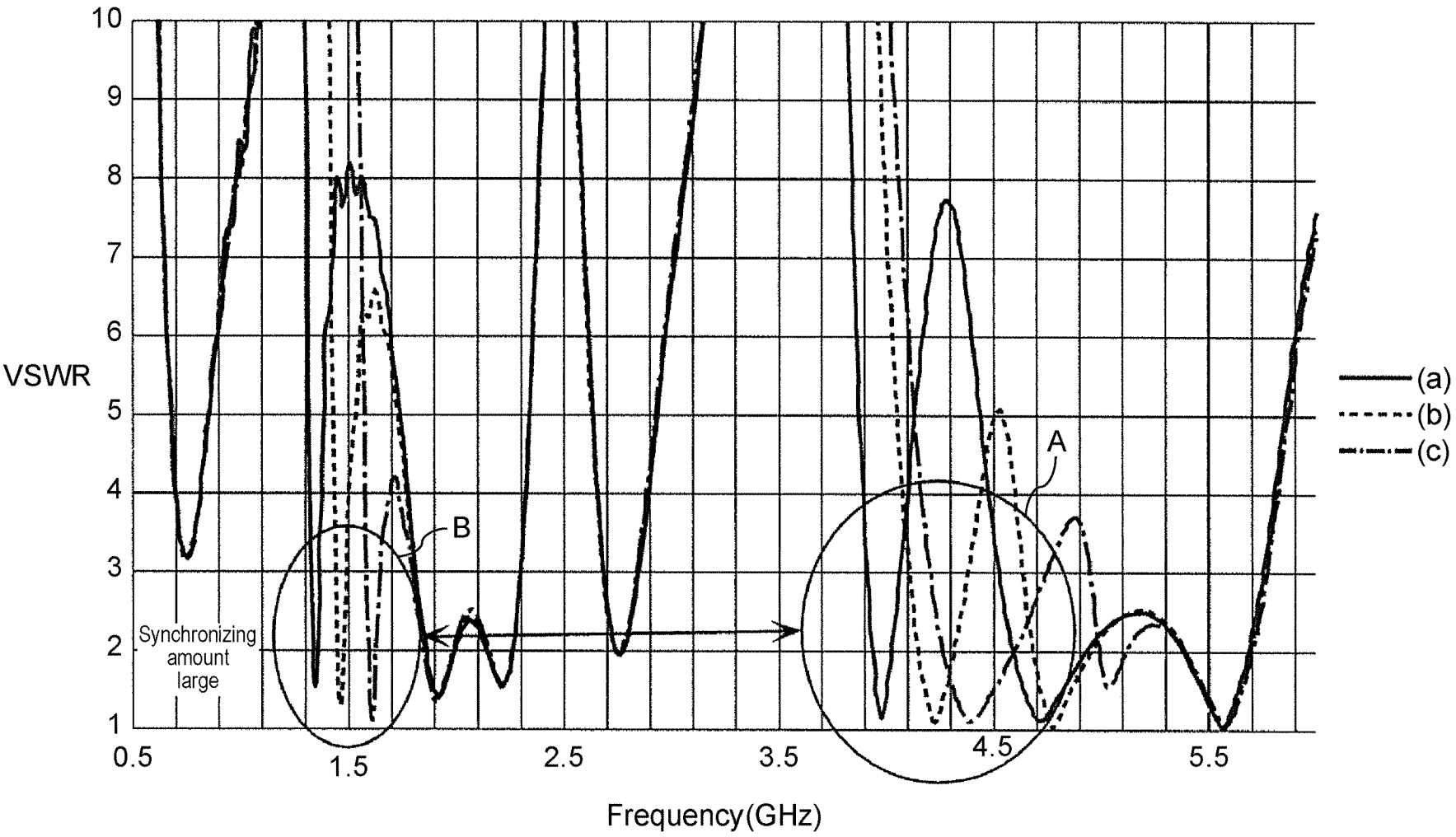
FIG. 4B is a graph showing frequency characteristics of voltage standing wave ratios in designs of parts (a) to (c) in FIG. 4A.

FIG. 4B is a graph showing frequency characteristics of voltage standing wave ratios in designs of parts (a) to (c) in FIG. 4A. The VSWR in the design of part (a) of FIG. 4A is indicated by a solid line, the VSWR in the design of part (b) of FIG. 4A is indicated by a broken line, and the VSWR in the design of part (c) of FIG. 4A is indicated by a dashed-dotted line.

In the conventional method of adjusting a frequency, the resonance frequency can be adjusted in the frequency band of part A in FIG. 4B by adjusting the length of linear part 101 in the x-axis direction. However, the resonance frequency also fluctuates in the frequency band of part B in FIG. 4B in sync with the adjustment. Thus, for example, in an attempt to achieve a multiband including 1.4 GHz (second frequency) and 3.5 GHz (fourth frequency), adjusting the resonance frequency to 3.5 GHz in the frequency band of part A makes it difficult to adjust the resonance frequency to 1.4 GHz in the frequency band of part B.

Next, a case where one example of the method of adjusting a frequency according to the exemplary embodiment is applied will be described using antenna device 2 according to the comparative example. In the exemplary embodiment, first radiating element 10 of antenna device 1 has U-shaped part 11. One example of the method of adjusting a frequency according to the exemplary embodiment is a method of adjusting the length of the slit of this U-shaped part by providing the U-shaped part.

Figure 5A:
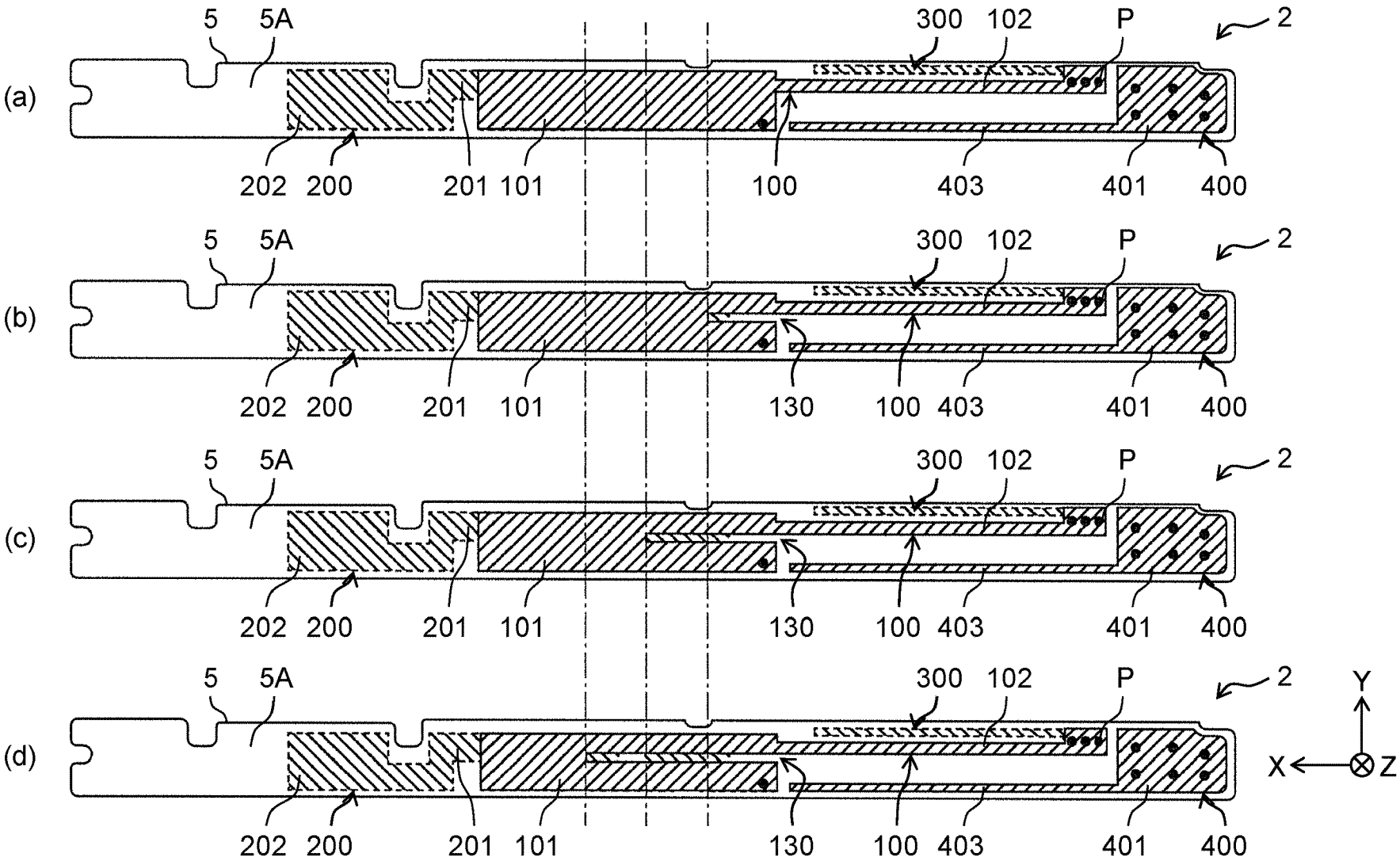
FIG. 5A is a diagram for explaining one example of a method of adjusting a frequency according to the exemplary embodiment.

FIG. 5A is a diagram for explaining one example of the method of adjusting a frequency according to the exemplary embodiment. In each of (b) to (d) in FIG. 5A, slit 130 is provided in linear part 101 of first radiating element 100, and the length of slit 130 in the x-axis direction is different. FIG. 5A is a case where slit 130 is not provided, and slit 130 is the shortest in part (b) of FIG. 5A and the longest in part (d) of FIG. 5A.

Figure 5B:
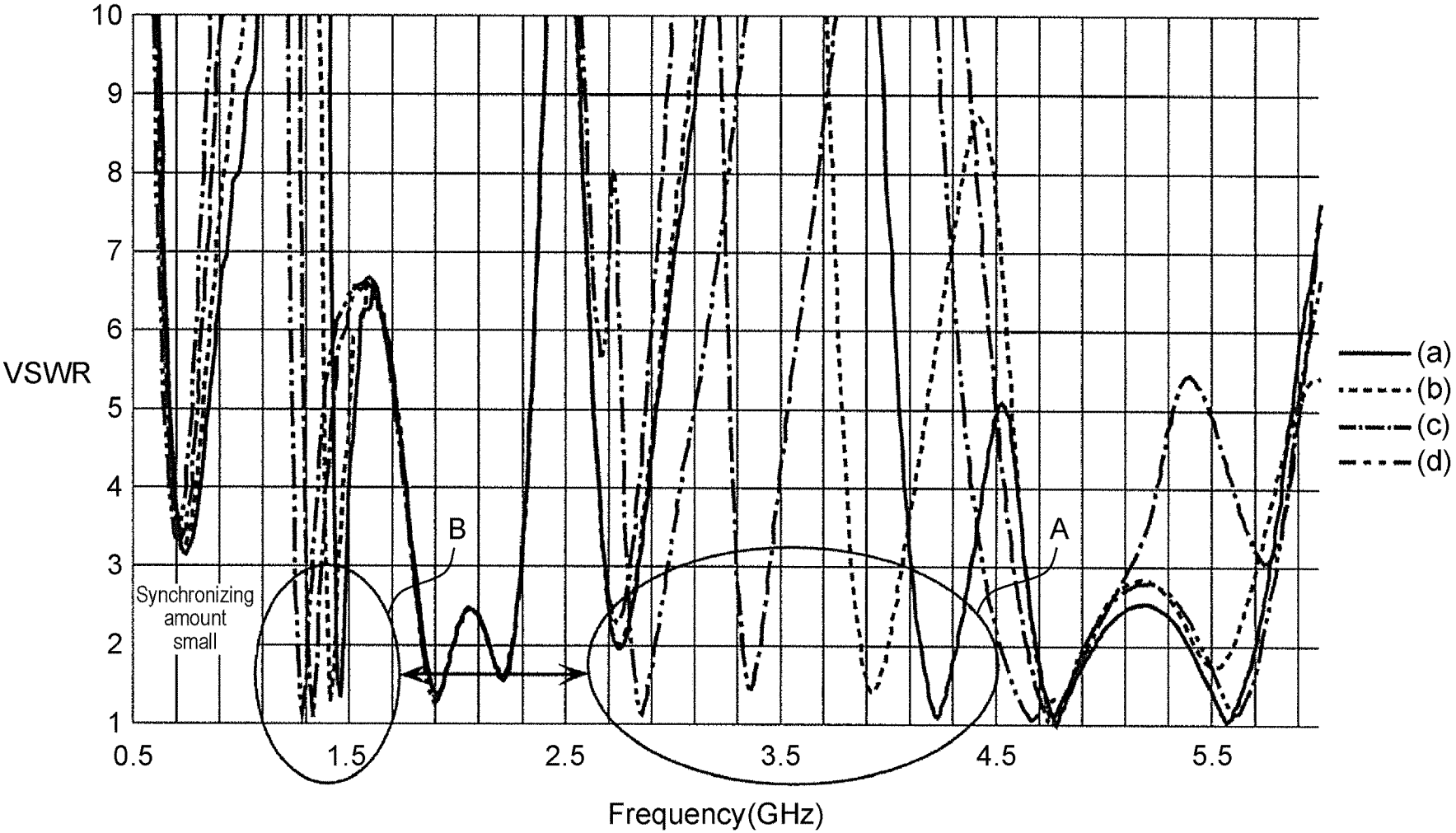
FIG. 5B is a graph showing frequency characteristics of voltage standing wave ratios in designs of parts (a) to (d) in FIG. 5A.

FIG. 5B is a graph showing frequency characteristics of voltage standing wave ratios in designs of parts (a) to (d) in FIG. 5A. The VSWR in the design of part (a) of FIG. 5A is indicated by a solid line, the VSWR in the design of part (b) of FIG. 5A is indicated by a broken line, the VSWR in the design of part (c) of FIG. 5A is indicated by a dashed-dotted line, and the VSWR in the design of part (d) of FIG. 5A is indicated by a chain double-dashed line.

The resonance frequency can be adjusted in the frequency band of part A in FIG. 5B by adjusting the length of slit 130 in the x-axis direction. Meanwhile, in the frequency band of part B in FIG. 5B, it can be seen that a synchronizing amount with the adjustment is smaller than a synchronizing amount in part B in FIG. 4B. Thus, for example, in an attempt to achieve a multiband including 1.4 GHz (second frequency) and 3.5 GHz (fourth frequency), by adjusting the length of the slit of the U-shaped part, the resonance frequency of the part resonating at the fourth frequency can be adjusted to a desired frequency while a fluctuation of the resonance frequency of the part resonating at the second frequency is suppressed although the part that resonates at the second frequency and the part that resonates at the fourth frequency commonly include U-shaped part. Accordingly, the resonance frequencies of both the part that resonates at the second frequency and the part that resonates at the fourth frequency can be set to desired frequencies.

Further, in antenna device 1 according to the exemplary embodiment, the part that resonates at the third frequency and the part that resonates at the fifth frequency commonly include meander-shaped part 31 of third radiating element 30. However, with a part commonly included in this way, adjusting a resonance frequency of one (for example, the part that resonates at the fifth frequency) will also change a resonance frequency of the other (for example, the part that resonates at the third frequency). However, in the present disclosure, by adjusting the distance between meander-shaped part 31 and first radiating element 10, the resonance frequency of the part resonating at the fifth frequency can be adjusted to a desired frequency while a fluctuation of the resonance frequency of the part resonating at the third frequency is suppressed. This will be described with reference to FIGS. 6A to 7B.

Figure 6A:
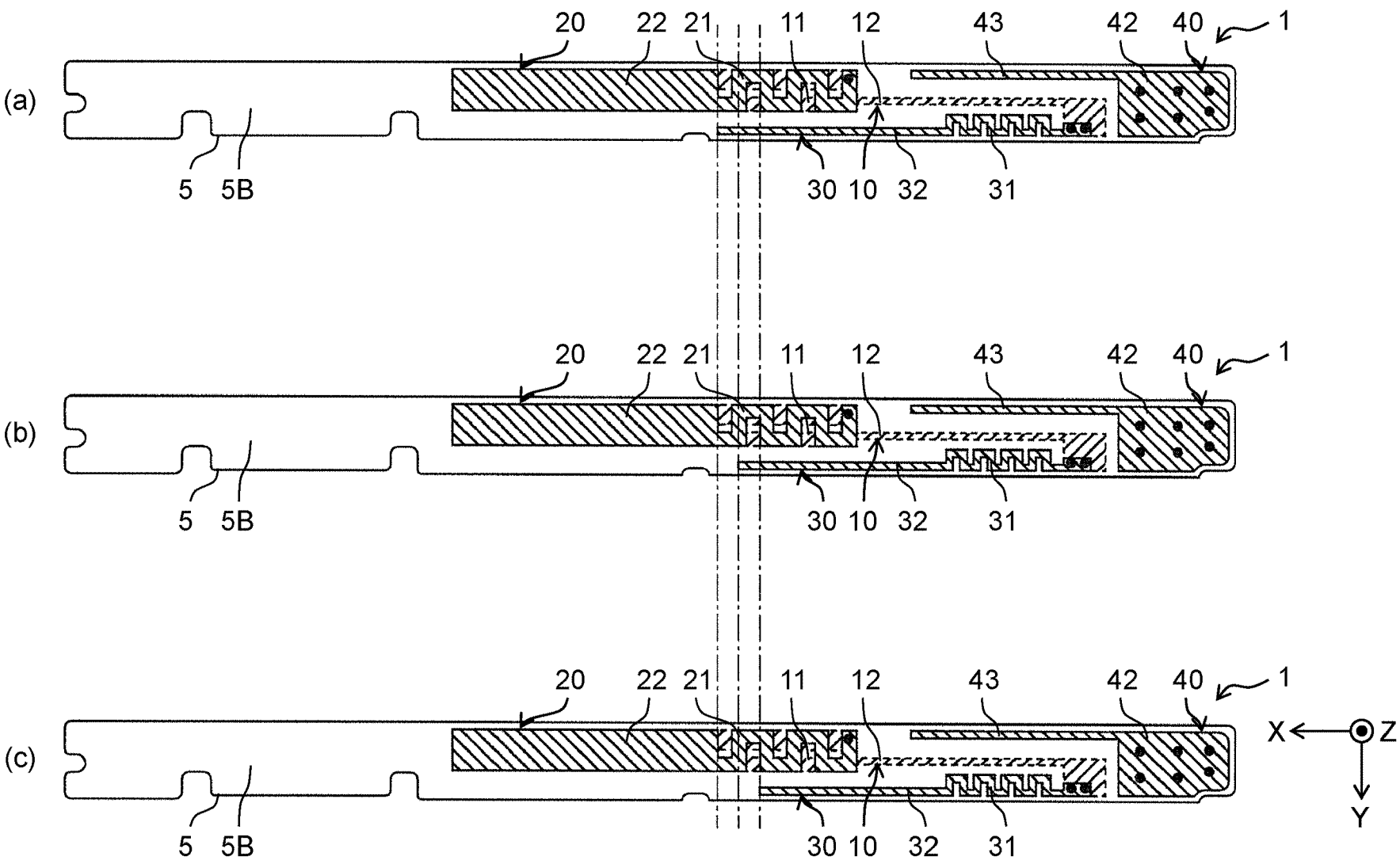
FIG. 6A is a diagram for explaining another example of the conventional method of adjusting a frequency using the antenna device according to the exemplary embodiment.

FIG. 6A is a diagram for explaining another example of the conventional method of adjusting a frequency. In FIG. 6A, one example of the conventional method of adjusting a frequency will be described using antenna device 1 according to the exemplary embodiment. The length of linear part 32 of third radiating element 30 in the x-axis direction is different in parts (a) to (c) of FIG. 6A. The length in part (a) of FIG. 6A is the longest, and the length in part (c) of FIG. 6A is the shortest.

Figure 6B:
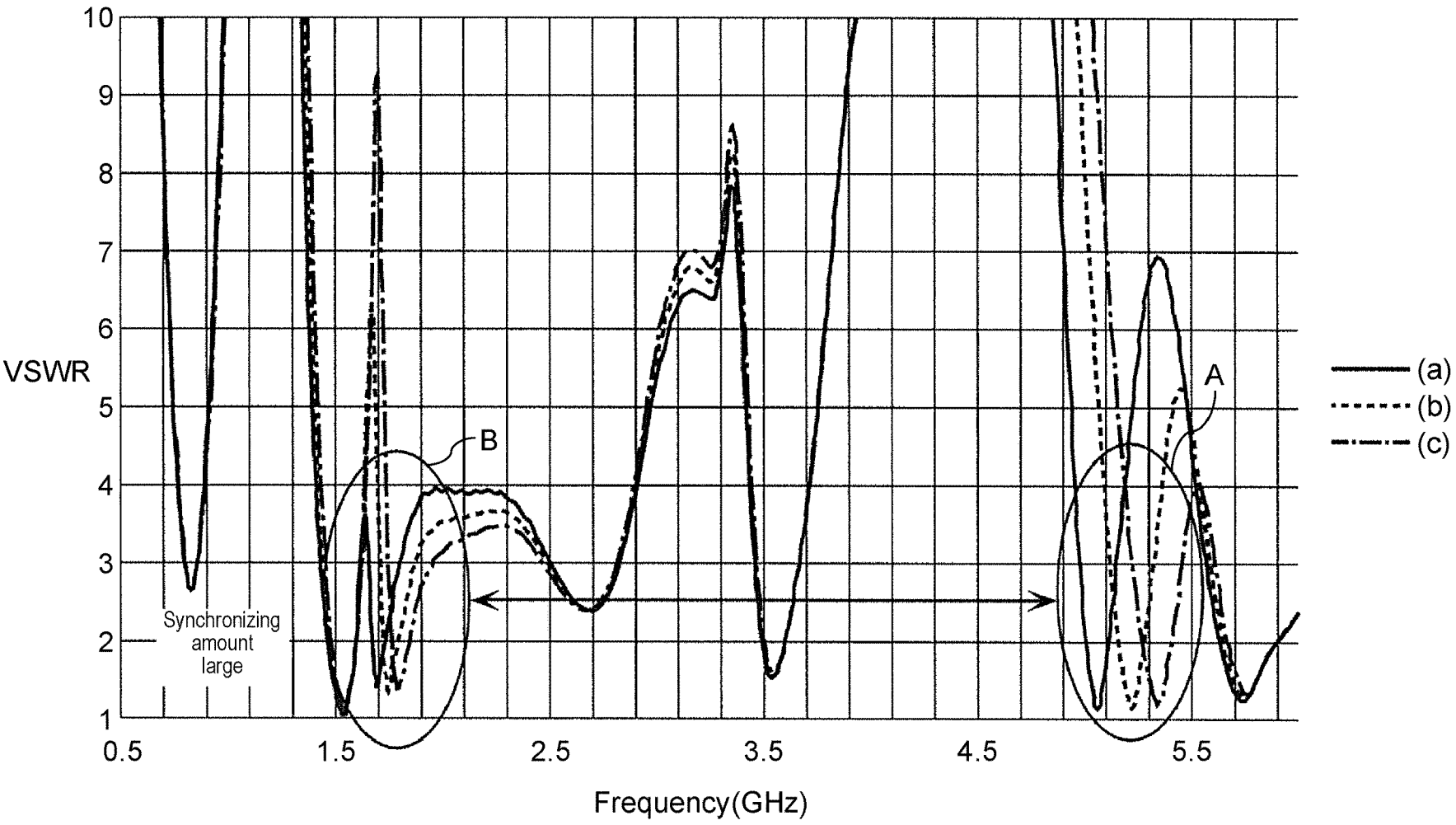
FIG. 6B is a graph showing frequency characteristics of voltage standing wave ratios in designs of parts (a) to (c) in FIG. 6A.

FIG. 6B is a graph showing frequency characteristics of voltage standing wave ratios in designs of parts (a) to (c) in FIG. 6A. The VSWR in the design of part (a) of FIG. 6A is indicated by a solid line, the VSWR in the design of part (b) of FIG. 6A is indicated by a broken line, and the VSWR in the design of part (c) of FIG. 6A is indicated by a dashed-dotted line.

In the conventional method of adjusting a frequency, the resonance frequency can be adjusted in the frequency band of part A in FIG. 6B by adjusting the length of linear part 32 in the x-axis direction. However, the resonance frequency also fluctuates in the frequency band of part B in FIG. 6B in sync with the adjustment. Thus, for example, in an attempt to achieve a multiband including 1.7 GHz (third frequency) and 5 GHz (fifth frequency), adjusting the resonance frequency to 5 GHz in the frequency band of part A makes it difficult to adjust the resonance frequency to 1.7 GHz in the frequency band of part B.

Next, a case where one example of the method of adjusting a frequency according to the exemplary embodiment is applied will be described using antenna device 1 according to the exemplary embodiment. Another example of the method of adjusting a frequency according to the exemplary embodiment is a method of adjusting the distance between meander-shaped part 31 and first radiating element 10.

Figure 7A:
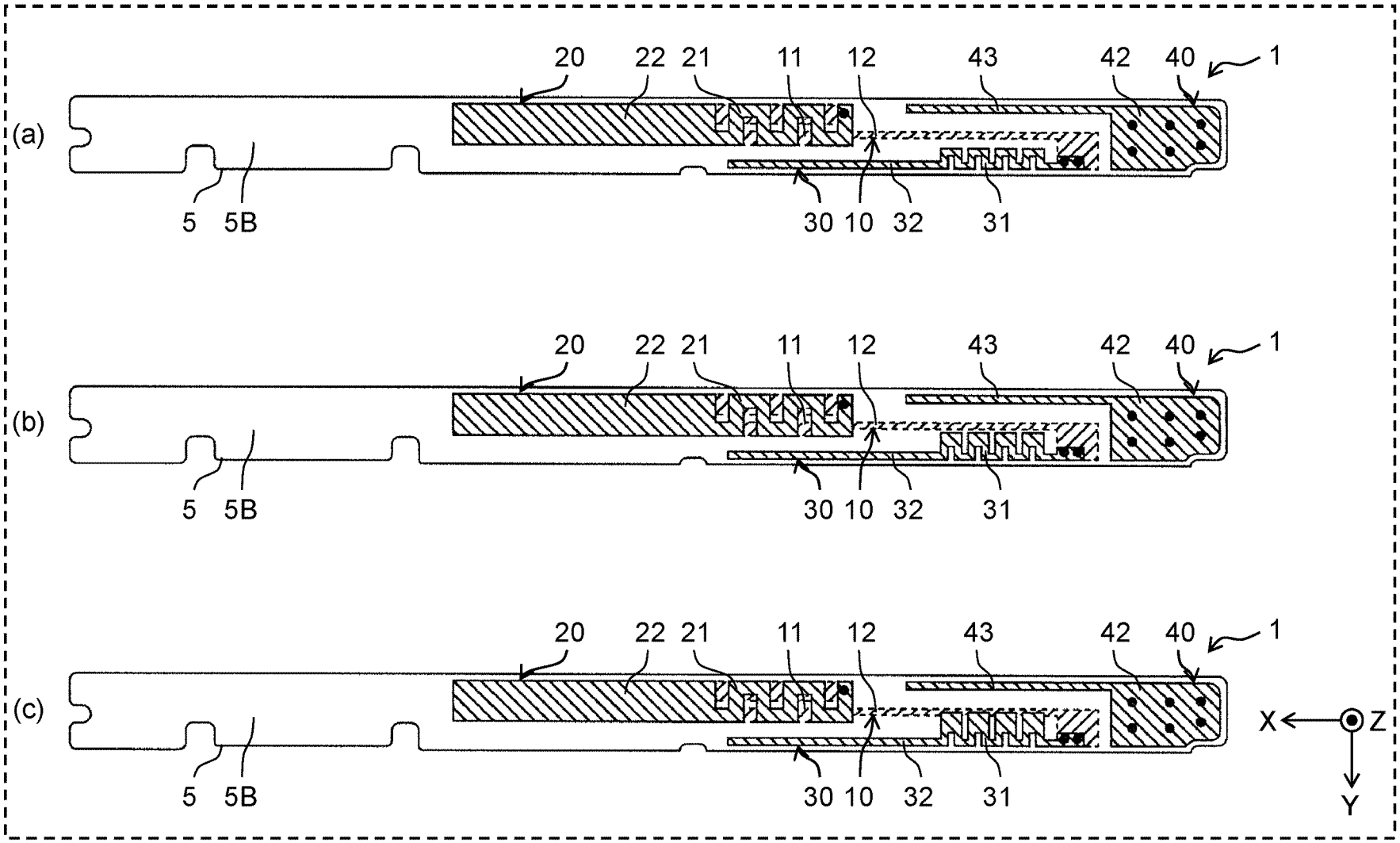
FIG. 7A is a diagram for explaining another example of the method of adjusting a frequency according to the exemplary embodiment.

FIG. 7A is a diagram for explaining another example of the method of adjusting a frequency according to the exemplary embodiment. The length of meander-shaped part 31 to the minus side in the y-axis direction is different in parts (a) to (c) of FIG. 7A. The length in part (a) of FIG. 7A is the shortest, and the length in part (c) of FIG. 7A is the longest.

Figure 7B:
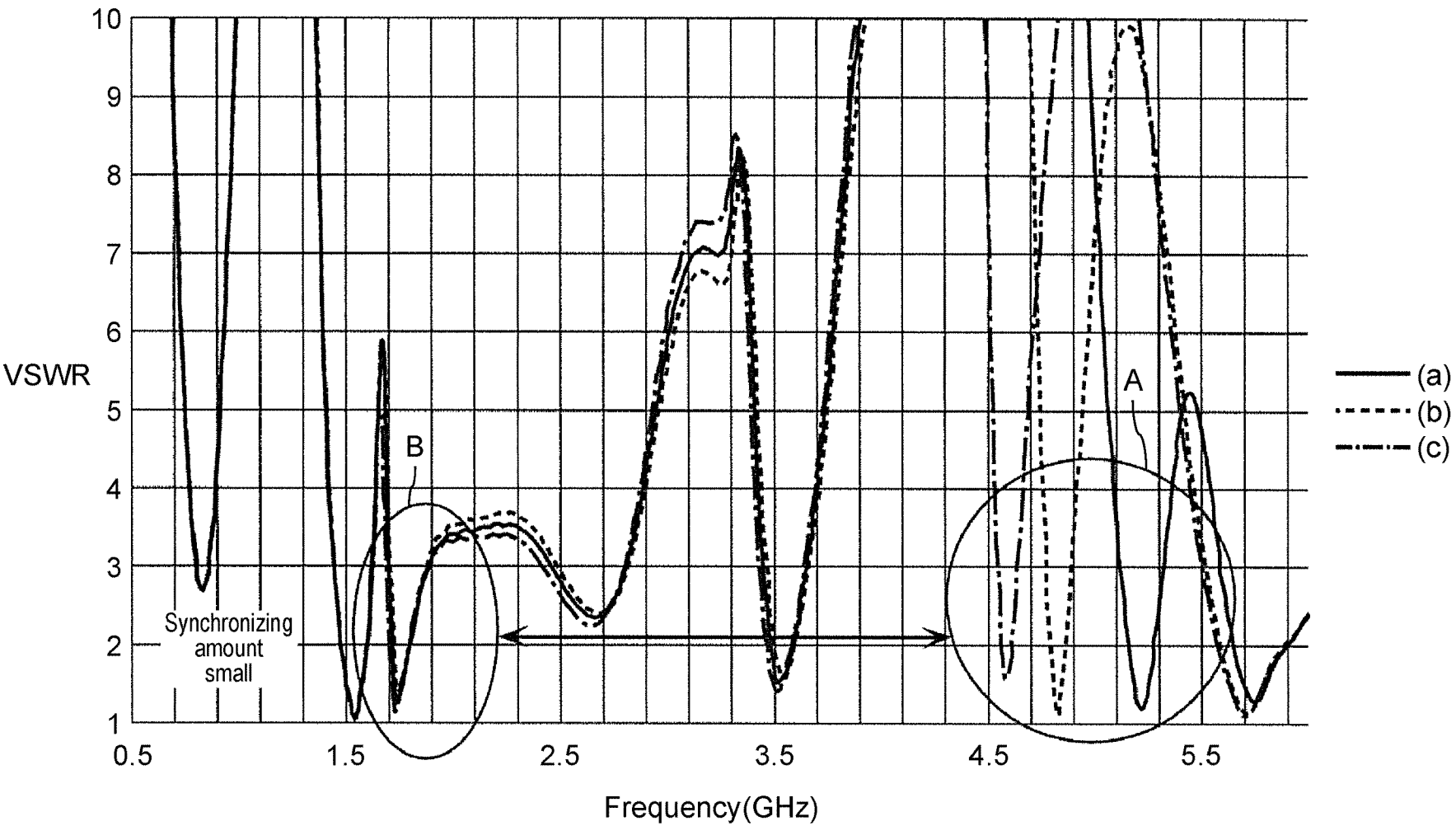
FIG. 7B is a graph showing frequency characteristics of the voltage standing wave ratios in designs of parts (a) to (c) in FIG. 7A.

FIG. 7B is a graph showing frequency characteristics of voltage standing wave ratios in designs of parts (a) to (c) in FIG. 7A. The VSWR in the design of part (a) of FIG. 7A is indicated by a solid line, the VSWR in the design of part (b) of FIG. 7A is indicated by a broken line, and the VSWR in the design of part (c) of FIG. 7A is indicated by a dashed-dotted line.

The resonance frequency can be adjusted in the frequency band of part A in FIG. 7B by adjusting the distance between meander-shaped part 31 and first radiating element 10 Meanwhile, in the frequency band of part B in FIG. 7B, it can be seen that a synchronizing amount with the adjustment is smaller than the synchronizing amount in part B in FIG. 6B. Thus, for example, in an attempt to achieve a multiband including 1.7 GHz (third frequency) and 5 GHz (fifth frequency), by adjusting the length of meander-shaped part 31 to first radiating element 10, the resonance frequency of the part resonating at the fifth frequency can be adjusted to a desired frequency while a fluctuation of the resonance frequency of the part resonating at the third frequency is suppressed although the part that resonates at the third frequency and the part that resonates at the fifth frequency commonly include meander-shaped part 31. Accordingly, the resonance frequencies of both the part that resonates at the third frequency and the part that resonates at the fifth frequency can be set to desired frequencies.

Next, a method of adjusting the first to sixth frequencies in antenna device 1 according to the exemplary embodiment will be described with reference to FIGS. 8A to 14B. The method of adjusting the first frequency and the second frequency will be described in comparison with a method of adjusting in antenna device 2 according to the comparative example.

Figure 8A:
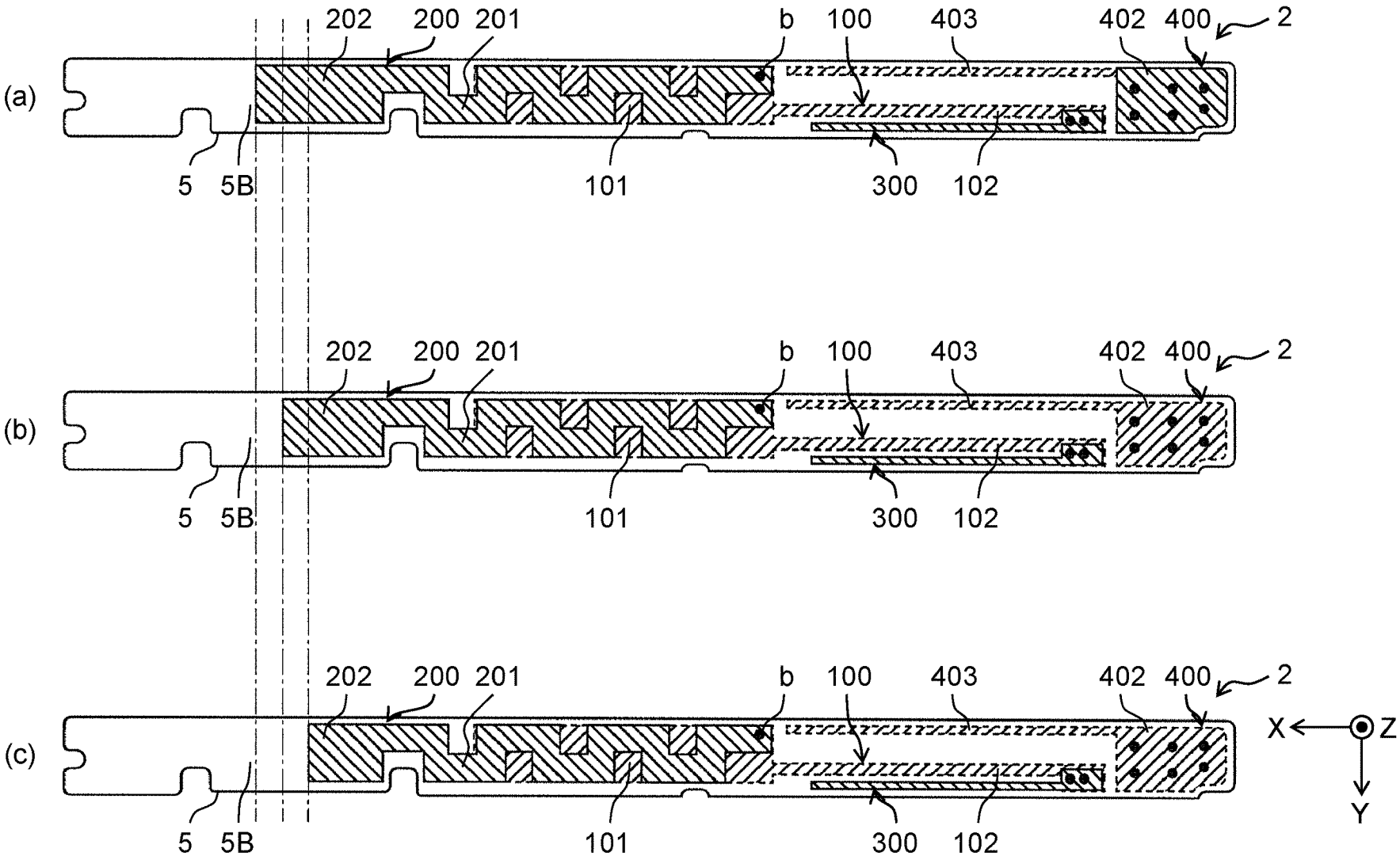
FIG. 8A is a diagram for explaining one example of a method of adjusting a first frequency in the antenna device according to the comparative example.

FIG. 8A is a diagram for explaining one example of a method of adjusting the first frequency in antenna device 2 according to the comparative example. The length of linear part 202 of second radiating element 200 in the x-axis direction is different in parts (a) to (c) of FIG. 8A. The length in part (a) of FIG. 8A is the longest, and the length in part (c) of FIG. 8A is the shortest.

Figure 8B:
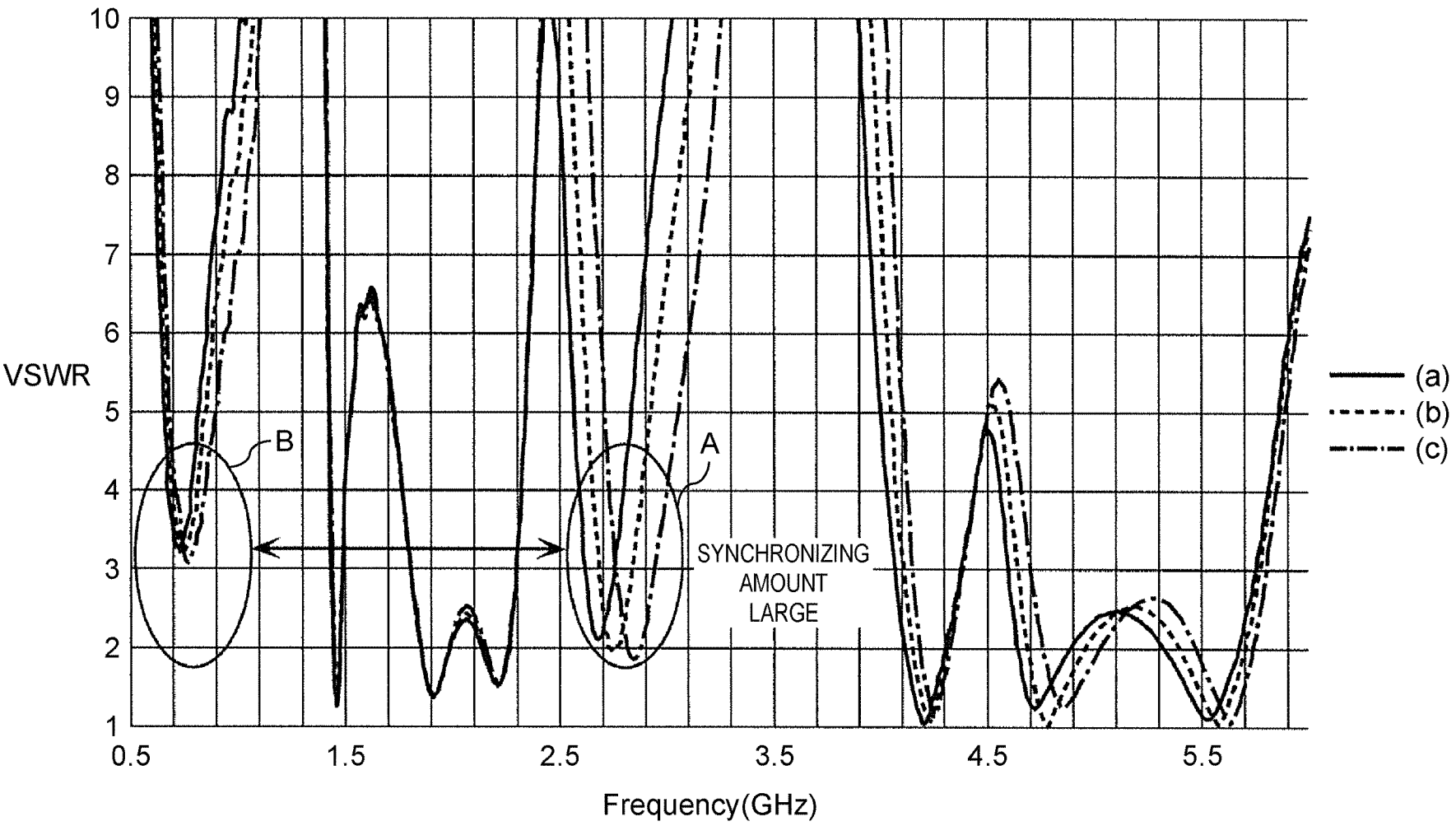
FIG. 8B is a graph showing frequency characteristics of voltage standing wave ratios in designs of parts (a) to (c) in FIG. 8A.

FIG. 8B is a graph showing frequency characteristics of voltage standing wave ratios in designs of parts (a) to (c) in FIG. 8A. The VSWR in the design of part (a) of FIG. 8A is indicated by a solid line, the VSWR in the design of part (b) of FIG. 8A is indicated by a broken line, and the VSWR in the design of part (c) of FIG. 8A is indicated by a dashed-dotted line.

In the method of adjusting the first frequency in antenna device 2 according to the comparative example, the resonance frequency can be adjusted in the frequency band of part B in FIG. 8B by adjusting the length of linear part 202 in the x-axis direction. However, the resonance frequency also fluctuates in the frequency band of part A in FIG. 8B in sync with the adjustment. This is because the sixth frequency becomes a harmonic frequency of the first frequency. This makes it difficult to achieve a multiband including, for example, 0.8 GHz (first frequency) and 2.6 GHz (sixth frequency).

Figure 9A:
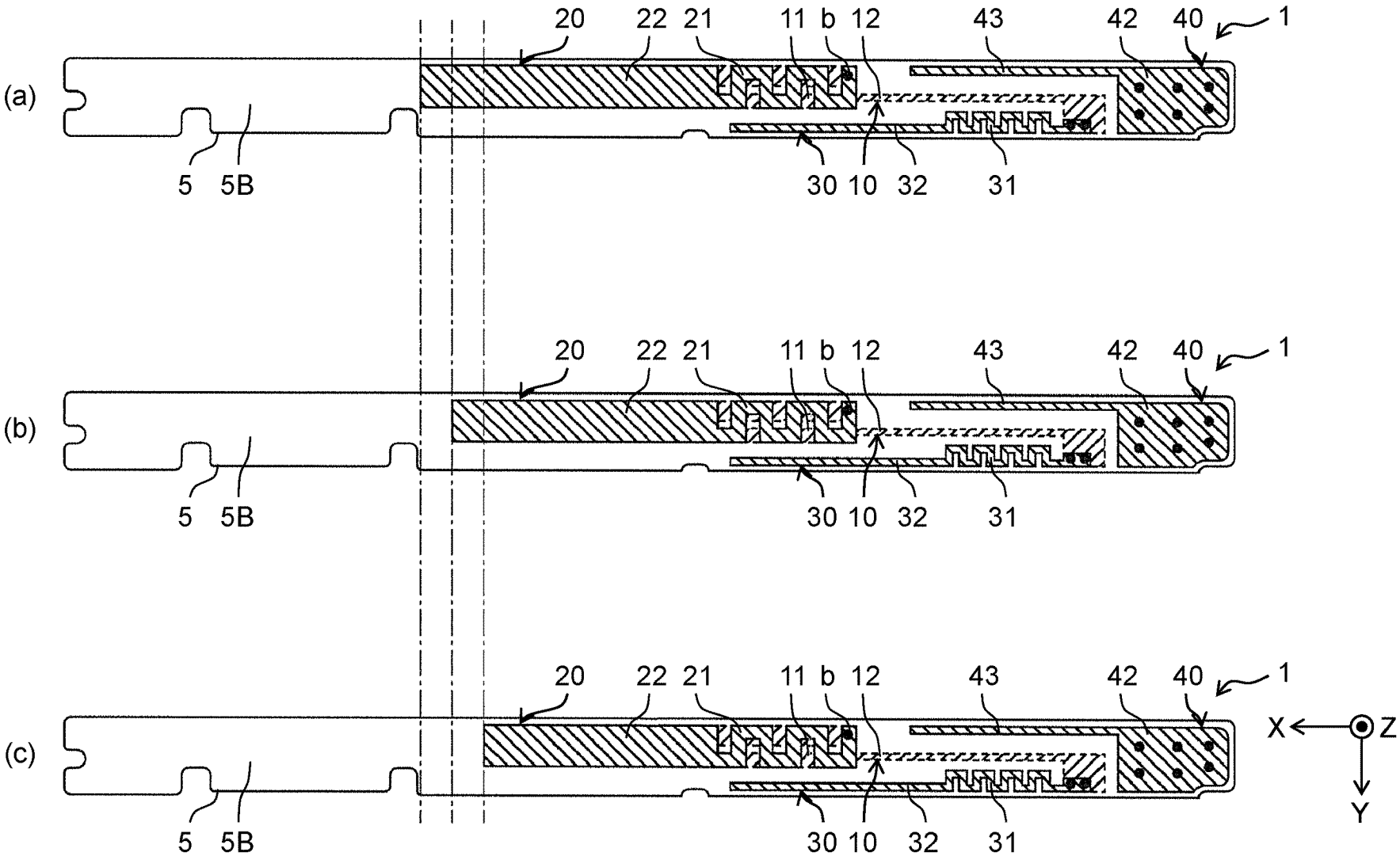
FIG. 9A is a diagram for explaining one example of the method of adjusting the first frequency in the antenna device according to the exemplary embodiment.

FIG. 9A is a diagram for explaining one example of the method of adjusting the first frequency in antenna device 1 according to the exemplary embodiment. The length of linear part 22 of second radiating element 20 in the x-axis direction is different in parts (a) to (c) of FIG. 9A. The length in part (a) of FIG. 9A is the longest, and the length in part (c) of FIG. 9A is the shortest.

Figure 9B:
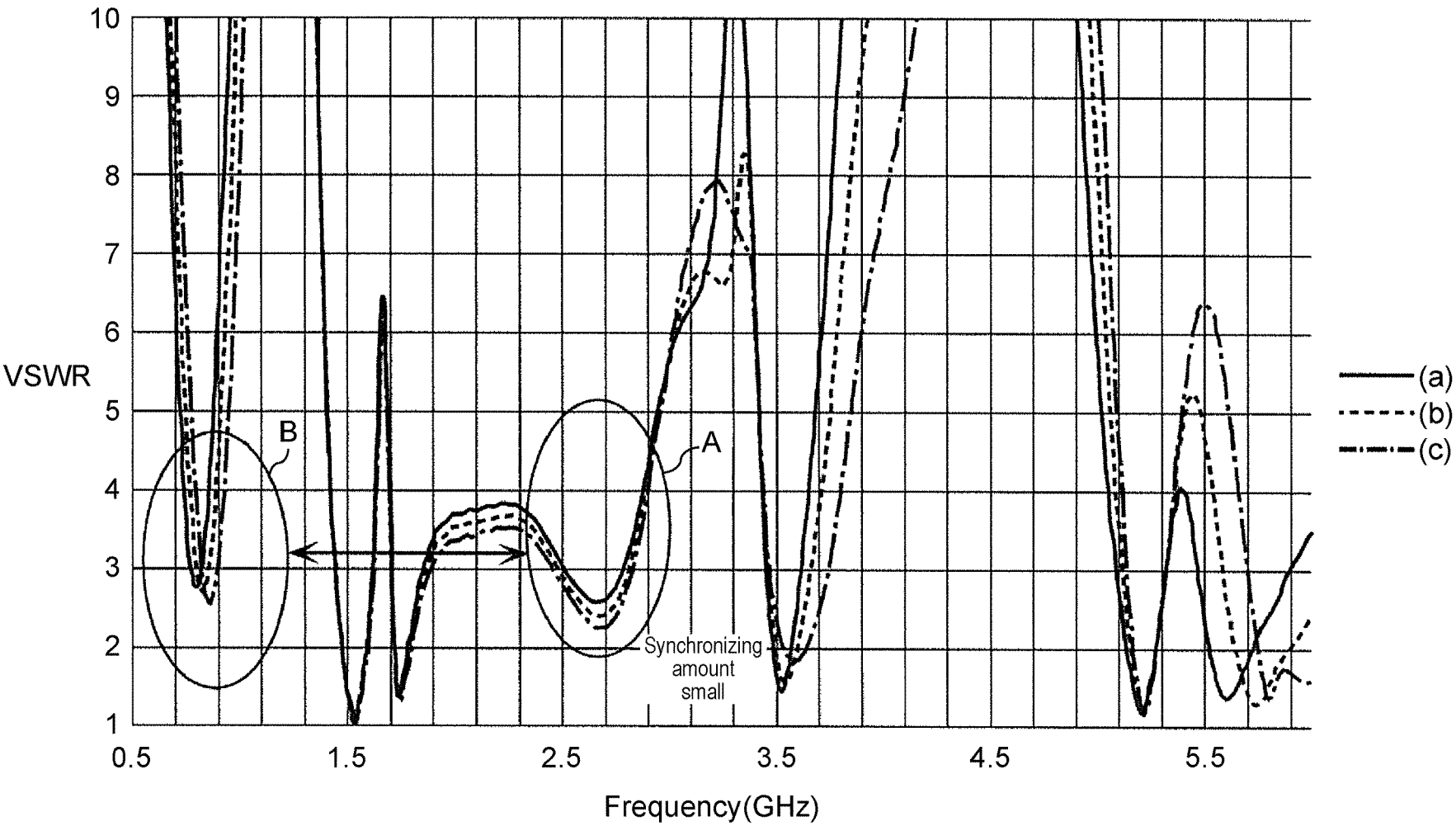
FIG. 9B is a graph showing frequency characteristics of voltage standing wave ratios in designs of parts (a) to (c) in FIG. 9A.

FIG. 9B is a graph showing frequency characteristics of voltage standing wave ratios in designs of parts (a) to (c) in FIG. 9A. The VSWR in the design of part (a) of FIG. 9A is indicated by a solid line, the VSWR in the design of part (b) of FIG. 9A is indicated by a broken line, and the VSWR in the design of part (c) of FIG. 9A is indicated by a dashed-dotted line.

In the method of adjusting the first frequency in antenna device 1 according to the exemplary embodiment, the resonance frequency can be adjusted in the frequency band of part B in FIG. 9B by adjusting the length of linear part 22 in the x-axis direction. Meanwhile, in the frequency band of part A in FIG. 9B, it can be seen that a synchronizing amount with the adjustment is smaller than the synchronizing amount in part A in FIG. 8B. In this way, in antenna device 1 according to the exemplary embodiment, it is possible to adjust 0.8 GHz (first frequency) while fluctuations in other frequency bands is suppressed.

Figure 10A:
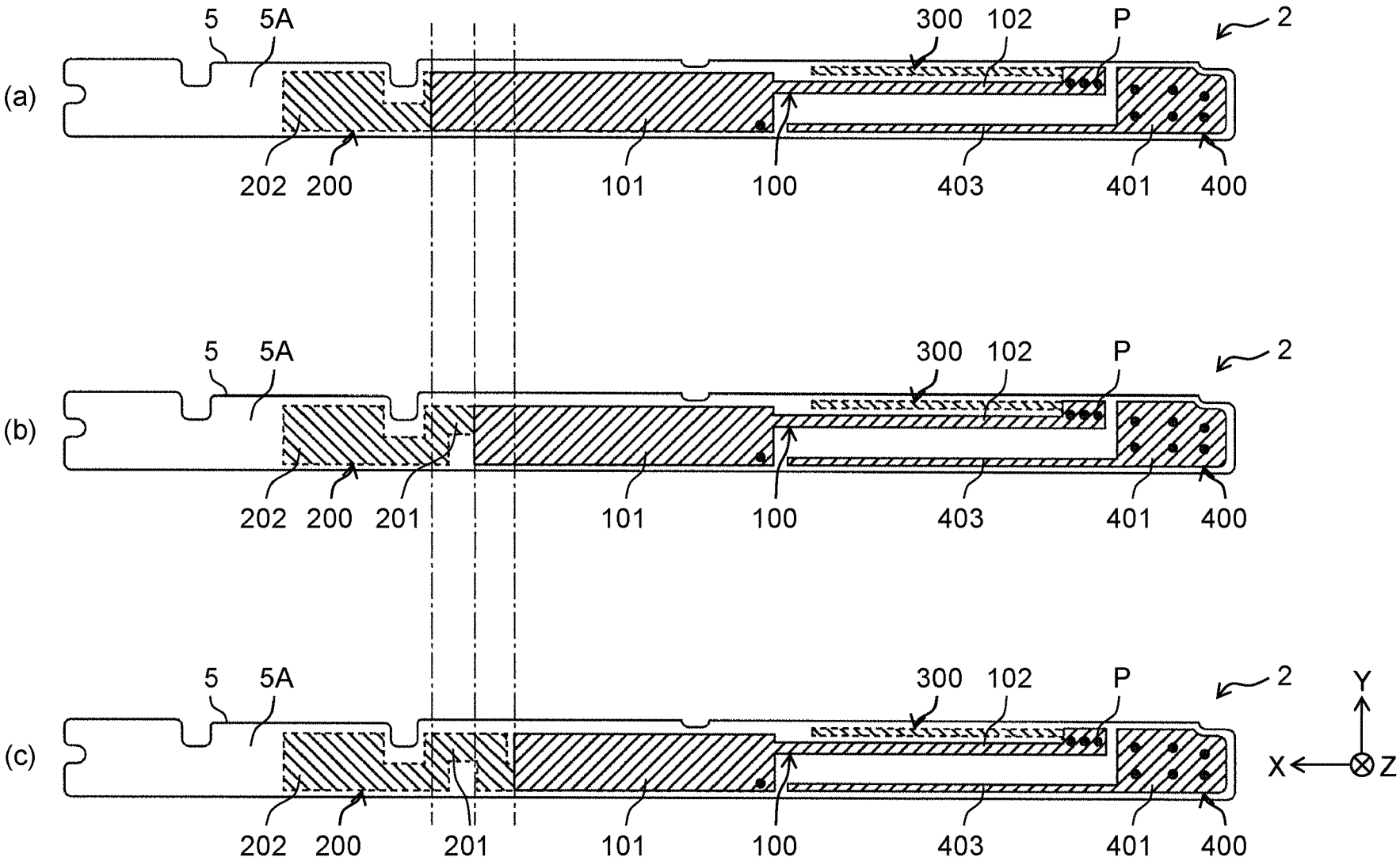
FIG. 10A is a diagram for explaining one example of a method of adjusting a second frequency in the antenna device according to the comparative example.

FIG. 10A is a diagram for explaining one example of a method of adjusting the second frequency in antenna device 2 according to the comparative example. The length of linear part 101 of first radiating element 100 in the x-axis direction is different in parts (a) to (c) of FIG. 10A. The length in part (a) of FIG. 10A is the longest, and the length in part (c) of FIG. 10A is the shortest.

Figure 10B:
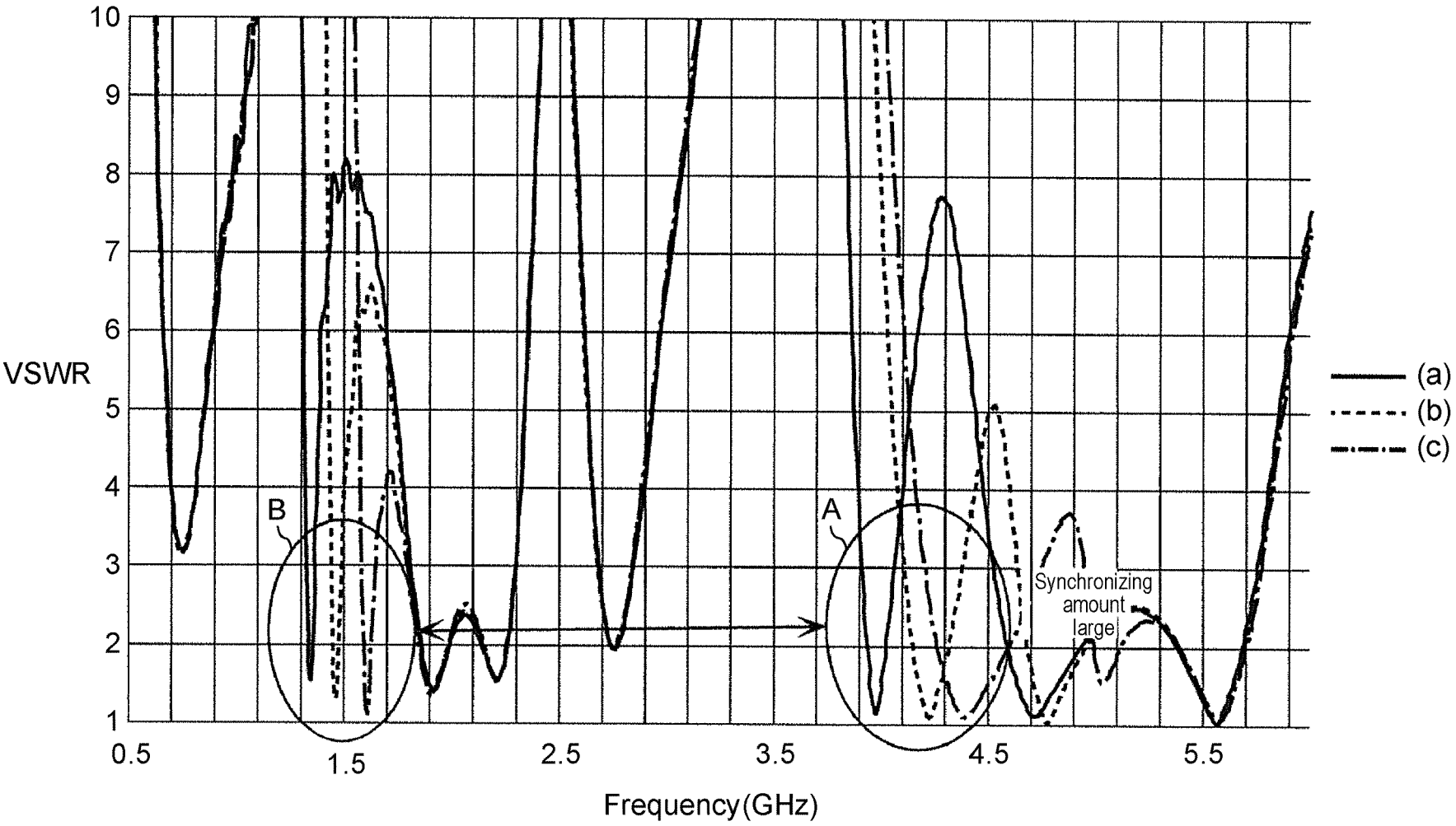
FIG. 10B is a graph showing frequency characteristics of voltage standing wave ratios in designs of parts (a) to (c) in FIG. 10A.

FIG. 10B is a graph showing frequency characteristics of voltage standing wave ratios in designs of parts (a) to (c) in FIG. 10A. The VSWR in the design of part (a) of FIG. 10A is indicated by a solid line, the VSWR in the design of part (b) of FIG. 10A is indicated by a broken line, and the VSWR in the design of part (c) of FIG. 10A is indicated by a dashed-dotted line.

In the method of adjusting the second frequency in antenna device 2 according to the comparative example, the resonance frequency can be adjusted in the frequency band of part B in FIG. 10B by adjusting the length of linear part 101 in the x-axis direction. However, the resonance frequency also fluctuates in the frequency band of part A in FIG. 10B in sync with the adjustment. This makes it difficult to achieve a multiband including, for example, 1.4 GHz (second frequency) and 3.5 GHz (fourth frequency).

Figure 11A:
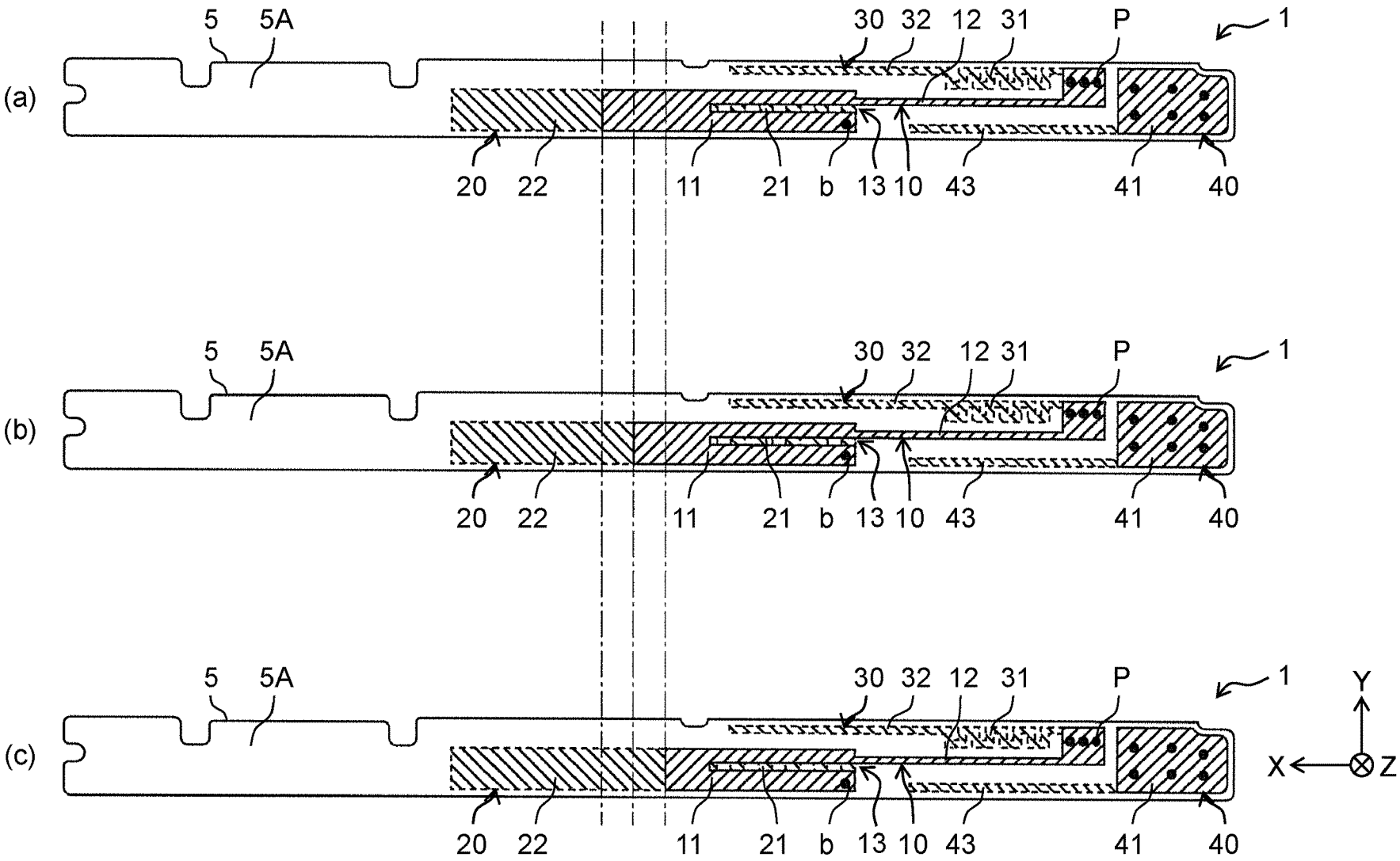
FIG. 11A is a diagram for explaining one example of a method of adjusting the second frequency in the antenna device according to the exemplary embodiment.

FIG. 11A is a diagram for explaining one example of the method of adjusting the second frequency in antenna device 1 according to the exemplary embodiment. The length of U-shaped part 11 of first radiating element 10 in the x-axis direction is different in parts (a) to (c) of FIG. 11A. The length in part (a) of FIG. 11A is the longest, and the length in part (c) of FIG. 11A is the shortest.

Figure 11B:
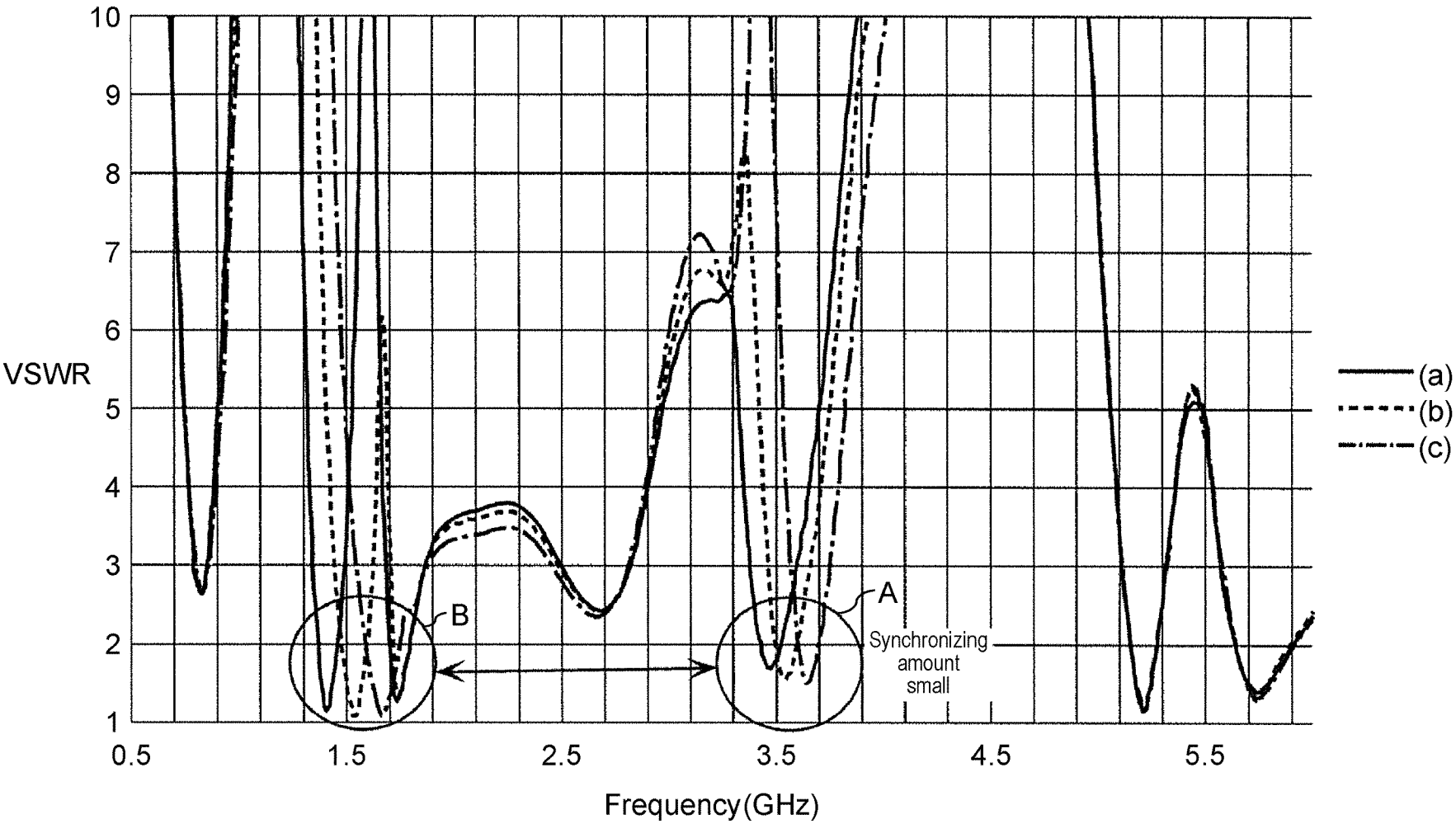
FIG. 11B is a graph showing frequency characteristics of voltage standing wave ratios in designs of parts (a) to (c) in FIG. 11A.

FIG. 11B is a graph showing frequency characteristics of voltage standing wave ratios in designs of parts (a) to (c) in FIG. 11A. The VSWR in the design of part (a) of FIG. 11A is indicated by a solid line, the VSWR in the design of part (b) of FIG. 11A is indicated by a broken line, and the VSWR in the design of part (c) of FIG. 11A is indicated by a dashed-dotted line.

In the method of adjusting the second frequency in antenna device 1 according to the exemplary embodiment, the resonance frequency can be adjusted in the frequency band of part B in FIG. 11B by adjusting the length of U-shaped part 11 in the x-axis direction. Meanwhile, in the frequency band of part A in FIG. 11B, it can be seen that the synchronizing amount with the adjustment is smaller than the synchronizing amount in part A in FIG. 10B. In this way, in antenna device 1 according to the exemplary embodiment, it is possible to adjust 1.4 GHz (second frequency) while fluctuations in other frequency bands is suppressed.

Figure 12A:
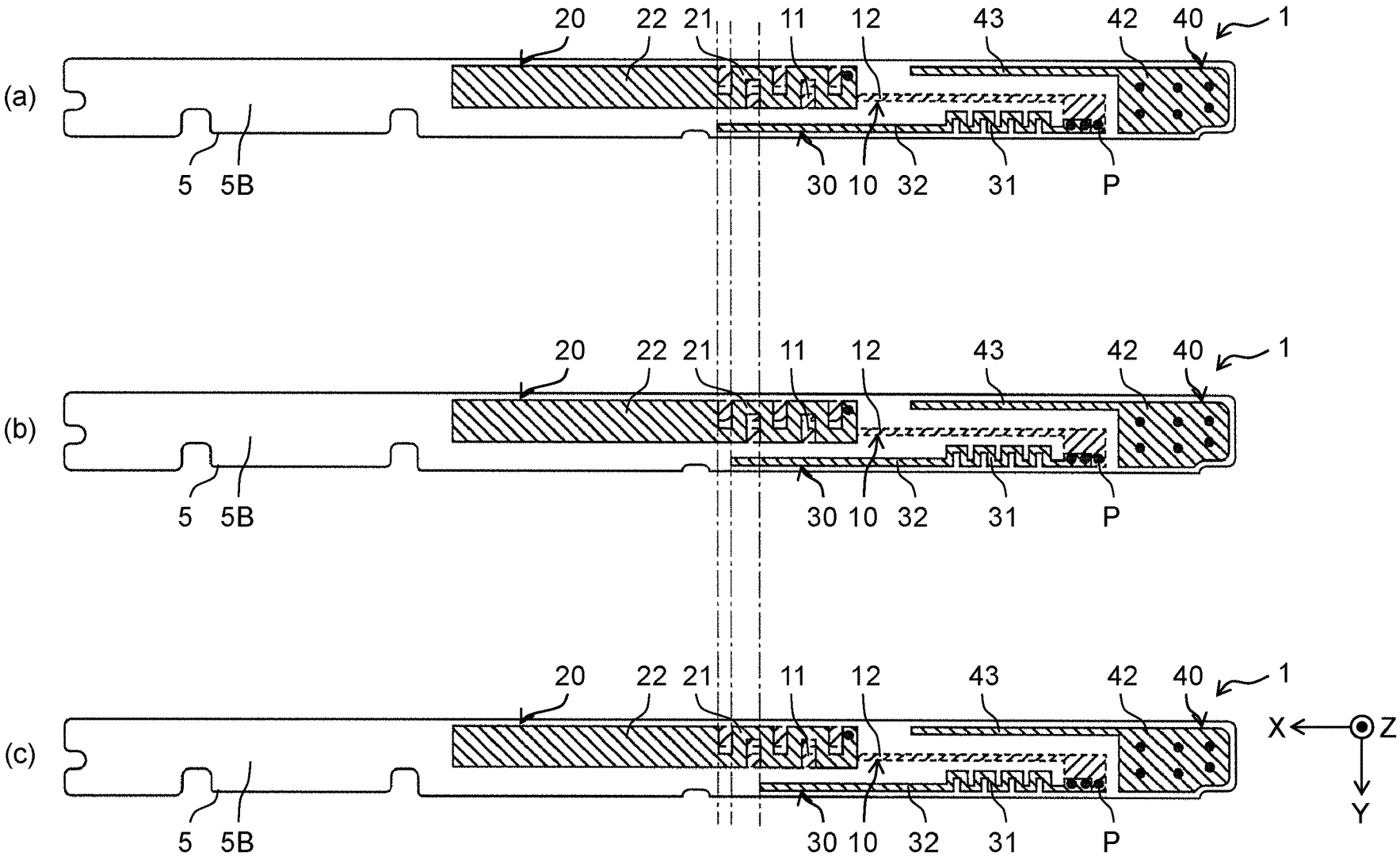
FIG. 12A is a diagram for explaining one example of a method of adjusting a third frequency in the antenna device according to the exemplary embodiment.

FIG. 12A is a diagram for explaining one example of the method of adjusting the third frequency in antenna device 1 according to the exemplary embodiment. The length of linear part 32 of third radiating element 30 in the x-axis direction is different in parts (a) to (c) of FIG. 12A. The length in part (a) of FIG. 12A is the longest, and the length in part (c) of FIG. 12A is the shortest.

Figure 12B:
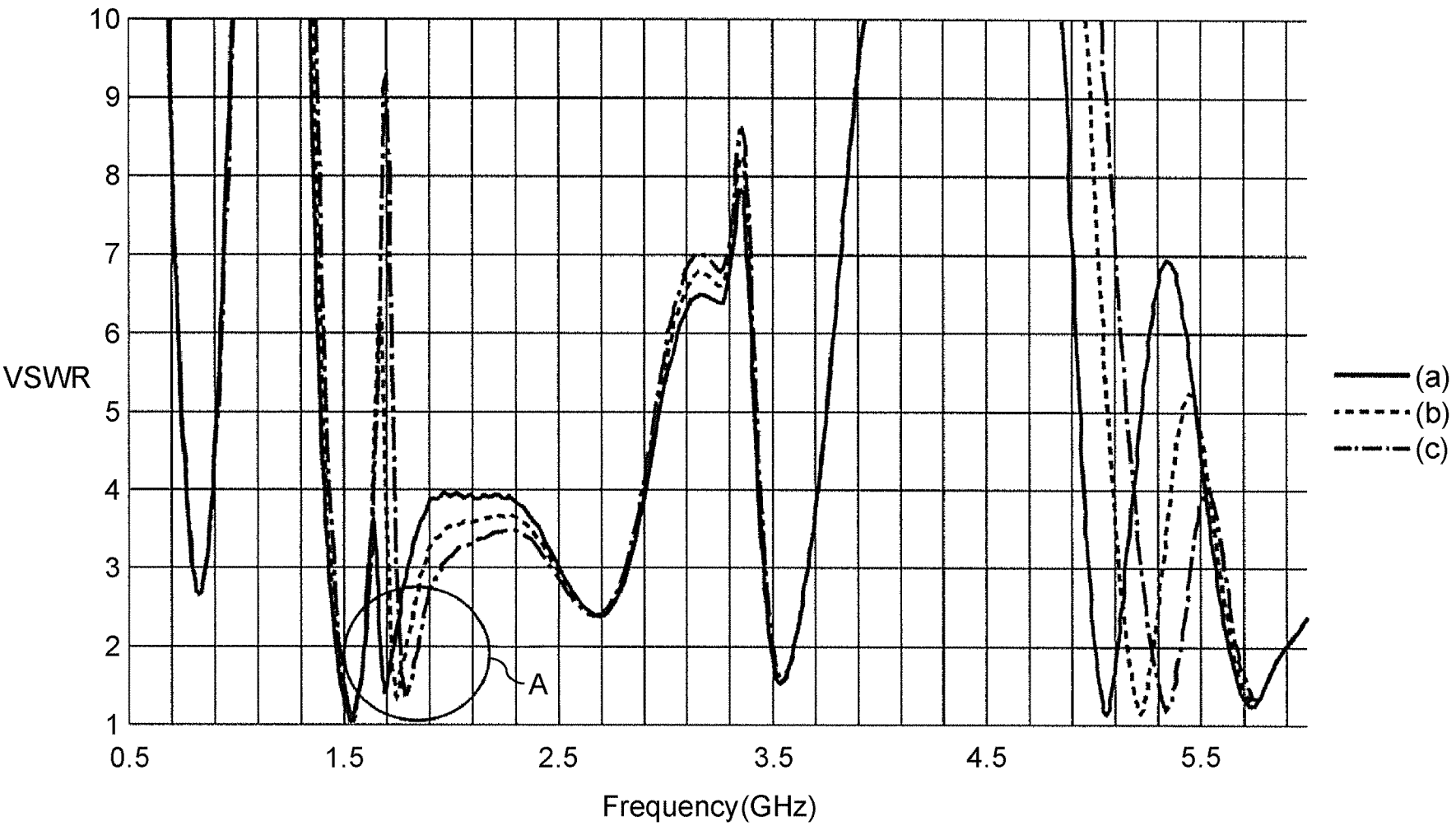
FIG. 12B is a graph showing frequency characteristics of voltage standing wave ratios in designs of parts (a) to (c) in FIG. 12A.

FIG. 12B is a graph showing frequency characteristics of voltage standing wave ratios in designs of parts (a) to (c) in FIG. 12A. The VSWR in the design of part (a) of FIG. 12A is indicated by a solid line, the VSWR in the design of part (b) of FIG. 12A is indicated by a broken line, and the VSWR in the design of part (c) of FIG. 12A is indicated by a dashed-dotted line.

In the method of adjusting the third frequency in antenna device 1 according to the exemplary embodiment, the resonance frequency can be adjusted in the frequency band of part A in FIG. 12B by adjusting the length of linear part 32 in the x-axis direction. For example, the third frequency can be adjusted to 1.7 GHz in the frequency band of part A in FIG. 12B.

Figure 13A:
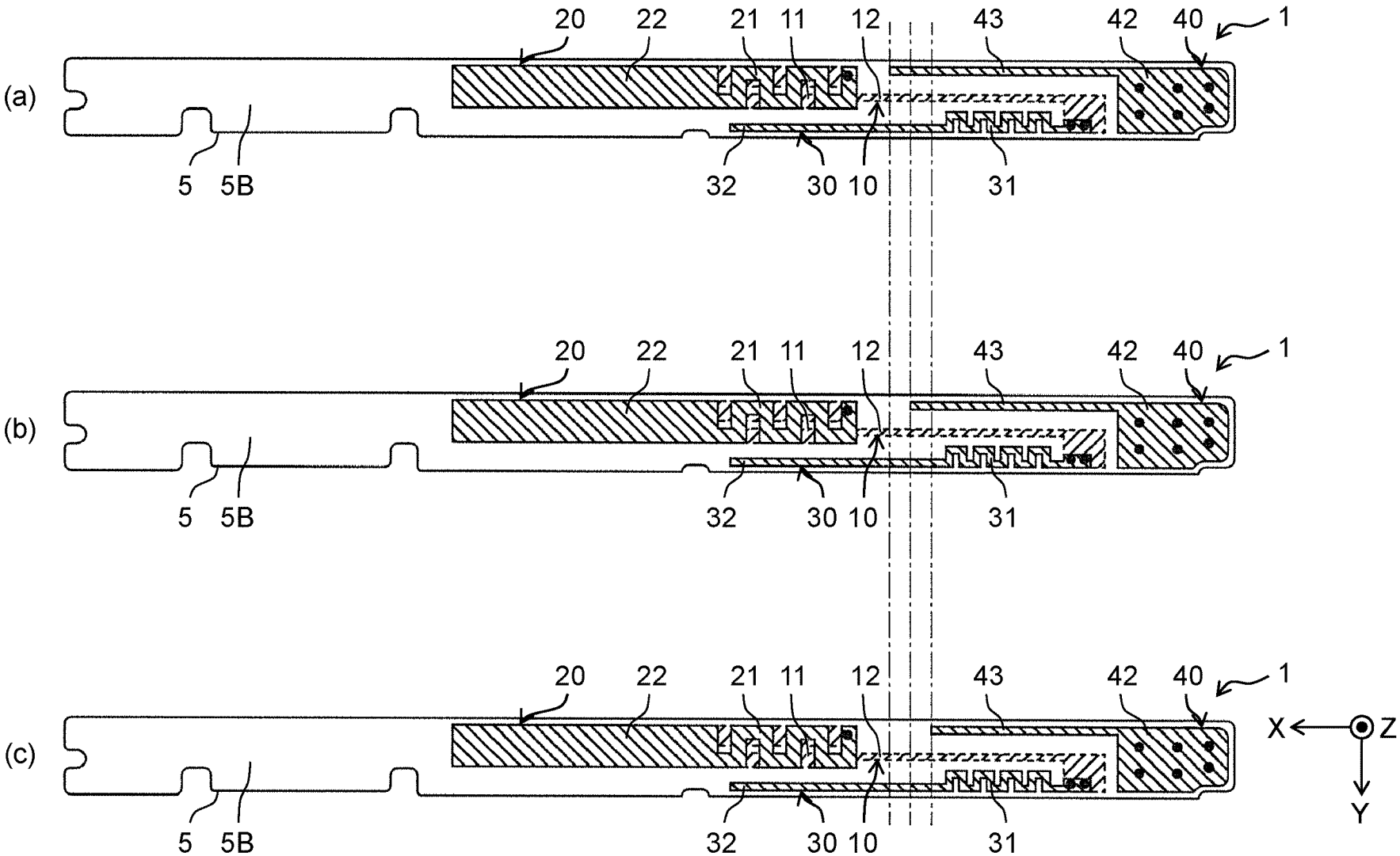
FIG. 13A is a diagram for explaining one example of a method of adjusting a sixth frequency in the antenna device according to the exemplary embodiment.

FIG. 13A is a diagram for explaining one example of the method of adjusting the sixth frequency in antenna device 1 according to the exemplary embodiment. Passive element 43 in the x-axis direction is different in parts (a) to (c) of FIG. 13A. The length in part (a) of FIG. 13A is the longest, and the length in part (c) of FIG. 13A is the shortest.

Figure 13B:
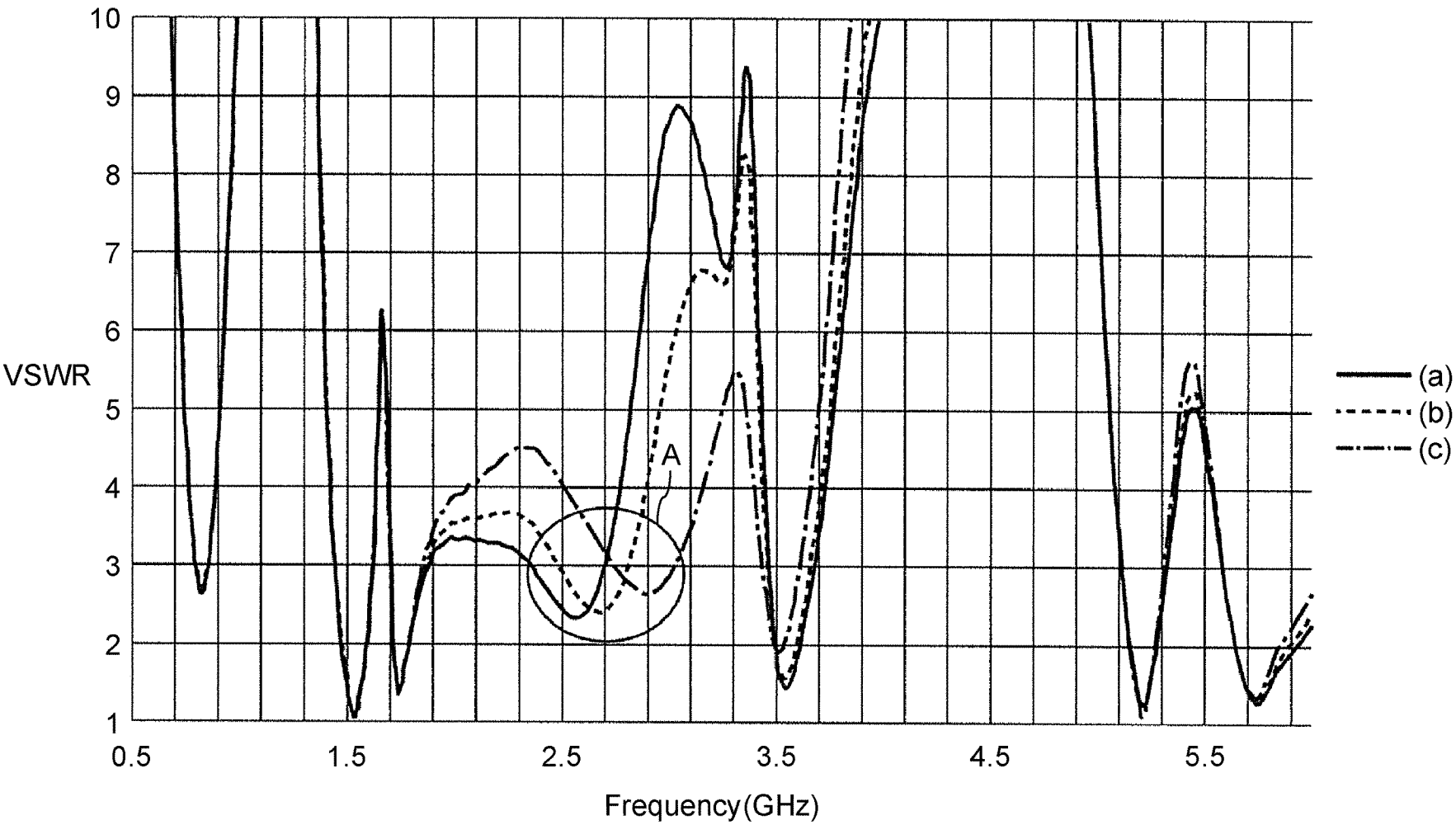
FIG. 13B is a graph showing frequency characteristics of voltage standing wave ratios in designs of parts (a) to (c) in FIG. 13A.

FIG. 13B is a graph showing frequency characteristics of voltage standing wave ratios in designs of parts (a) to (c) in FIG. 13A. The VSWR in the design of part (a) of FIG. 13A is indicated by a solid line, the VSWR in the design of part (b) of FIG. 13A is indicated by a broken line, and the VSWR in the design of part (c) of FIG. 13A is indicated by a dashed-dotted line.

In the method of adjusting the sixth frequency in antenna device 1 according to the exemplary embodiment, the resonance frequency can be adjusted in the frequency band of part A in FIG. 13B by adjusting the length of passive element 43 in the x-axis direction. For example, the sixth frequency can be adjusted to 2.6 GHz in the frequency band of part A in FIG. 13B.

Figure 14A:
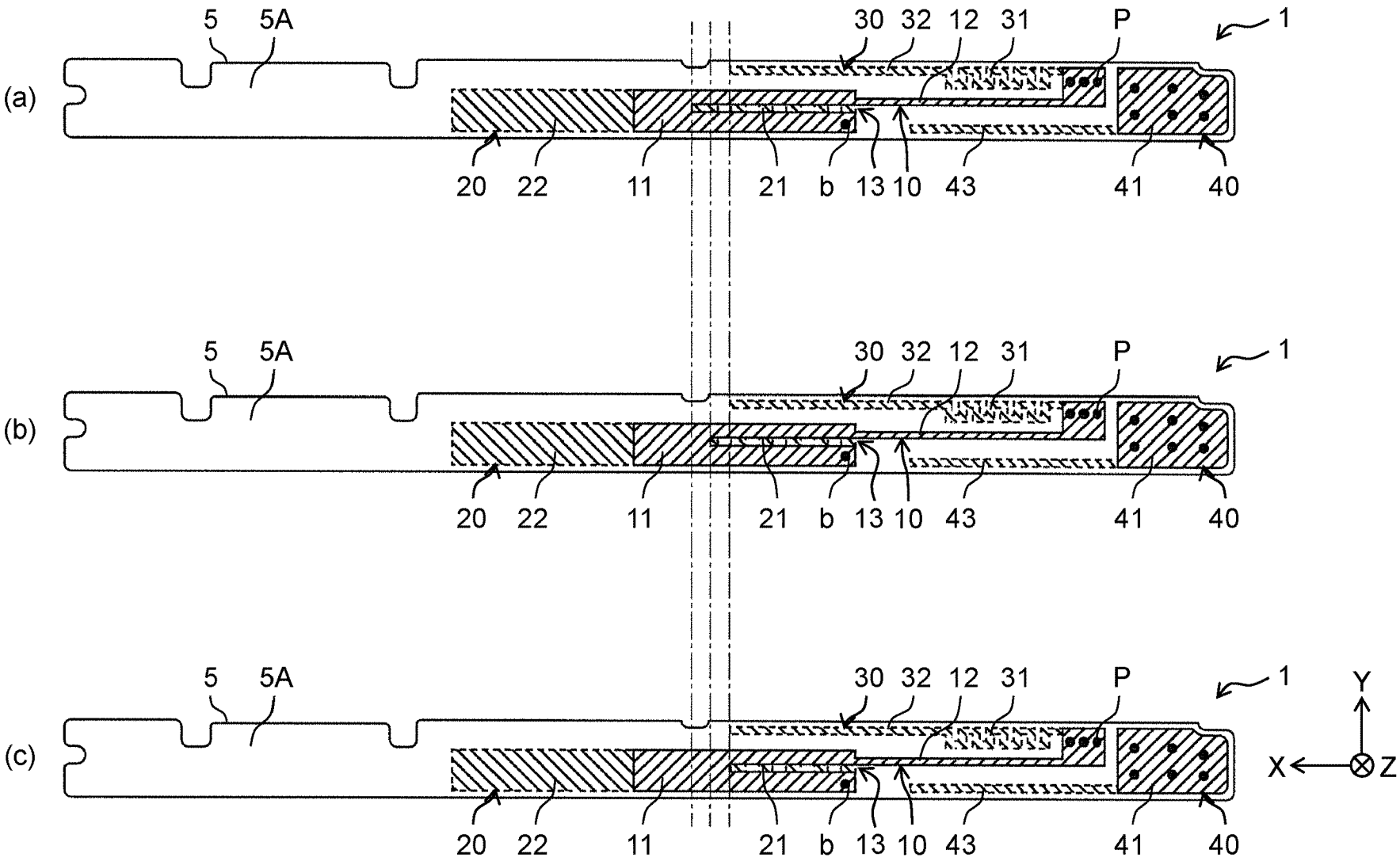
FIG. 14A is a diagram for explaining one example of a method of adjusting a fourth frequency in the antenna device according to the exemplary embodiment.

FIG. 14A is a diagram for explaining one example of the method of adjusting the fourth frequency in antenna device 1 according to the exemplary embodiment. The length of slit 13 of U-shaped part 11 of first radiating element 10 in the x-axis direction is different in parts (a) to (c) of FIG. 14A. The length in part (a) of FIG. 14A is the longest, and the length in part (c) of FIG. 14A is the shortest.

Figure 14B:
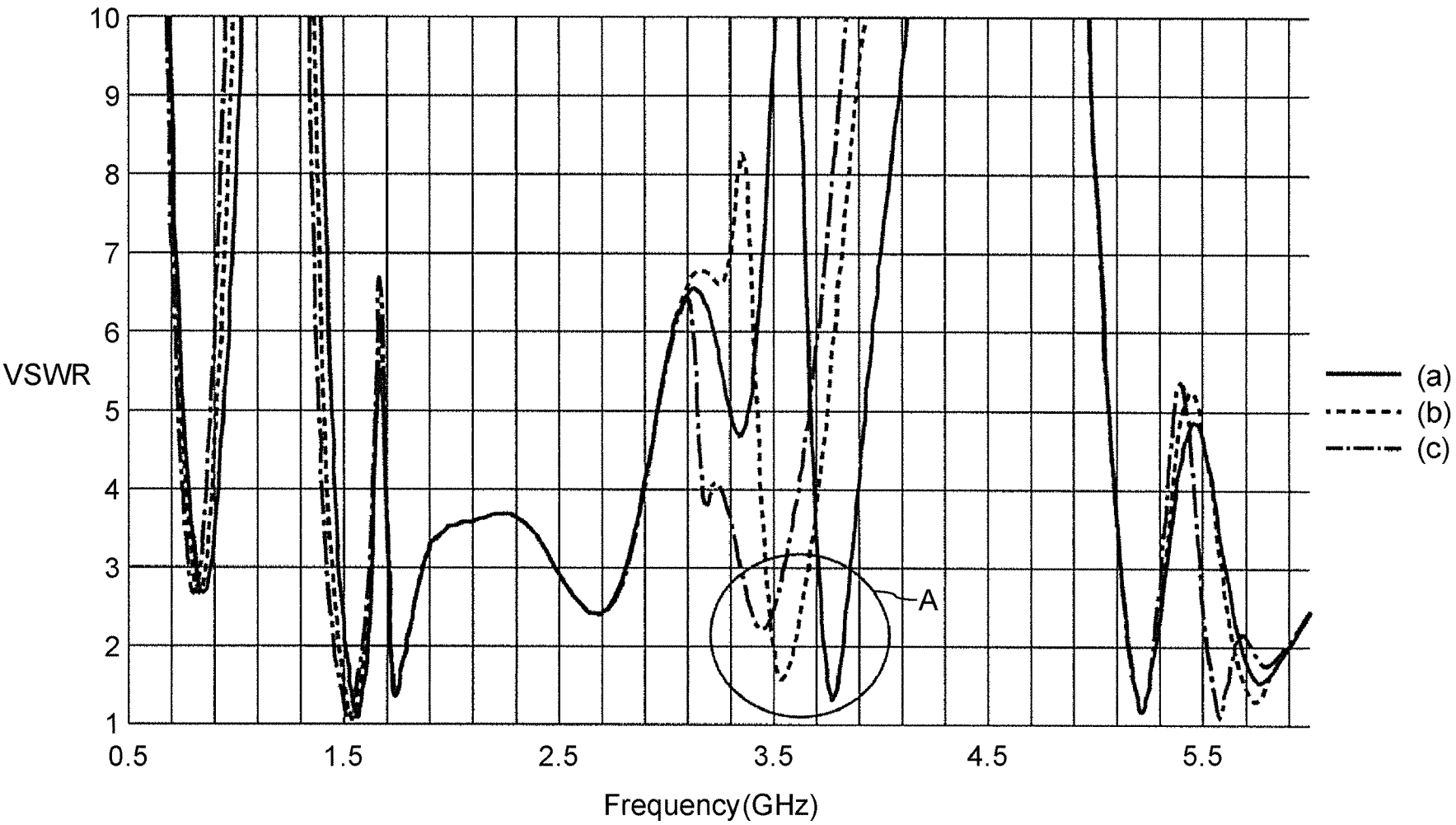
FIG. 14B is a graph showing frequency characteristics of voltage standing wave ratios in designs of parts (a) to (c) in FIG. 14A.

FIG. 14B is a graph showing frequency characteristics of voltage standing wave ratios in designs of parts (a) to (c) in FIG. 14A. The VSWR in the design of part (a) of FIG. 14A is indicated by a solid line, the VSWR in the design of part (b) of FIG. 14A is indicated by a broken line, and the VSWR in the design of part (c) of FIG. 14A is indicated by a dashed-dotted line.

In the method of adjusting the fourth frequency in antenna device 1 according to the exemplary embodiment, the resonance frequency can be adjusted in the frequency band of part A in FIG. 14B by adjusting the length of slit 13 in the x-axis direction. For example, the fourth frequency can be adjusted to 3.5 GHz in the frequency band of part A in FIG. 14B.

In this way, the first to sixth frequencies can be adjusted to the desired frequencies.

Antenna device 1 according to the exemplary embodiment is provided in a wireless communication device such as a laptop computer.

Figure 15:
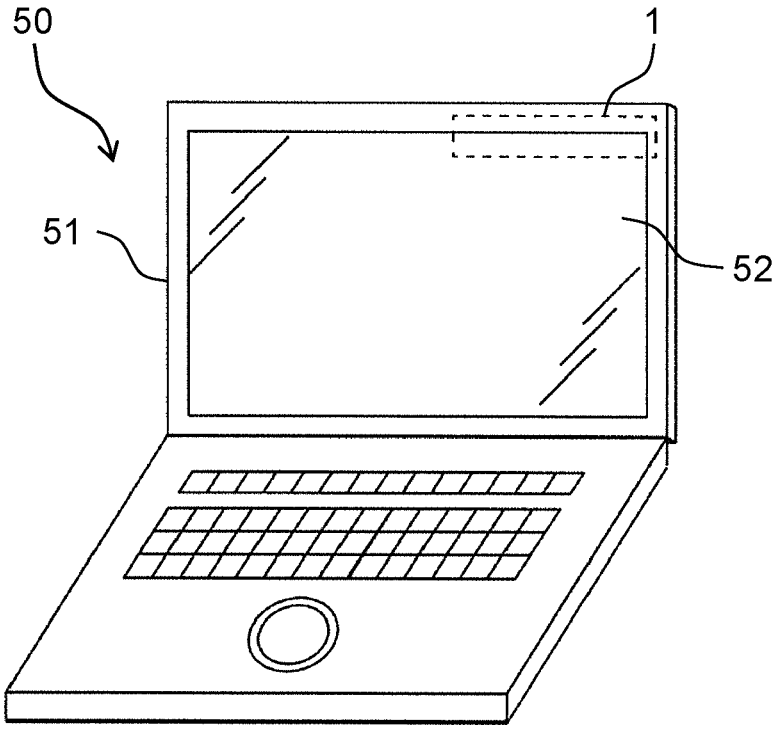
FIG. 15 is a diagram showing an outer appearance of a wireless communication device provided with the antenna device according to the exemplary embodiment.

FIG. 15 is a diagram showing an outer appearance of wireless communication device 50 provided with antenna device 1 according to the exemplary embodiment. Antenna device 1 is installed as wireless communication device 50 in, for example, housing 51 provided with liquid crystal display 52 of a laptop computer. Antenna device 1 is applicable not only to laptop computers but also to other wireless communication devices such as mobile terminals.

As described above, first radiating element 10 has U-shaped part 11, second radiating element 20 has meander-shaped part 21, third radiating element 30 has meander-shaped part 31. This can make antenna device 1 smaller.

Further, as shown in FIG. 3, antenna device 1 has a plurality of resonance frequencies. Specifically, the following parts (i) to (v) resonate at different frequencies. Part (i) is a part from feedpoint P through first radiating element 10 and interlayer connection conductor b to an end of second radiating element 20 on a side opposite to interlayer connection conductor b in the predetermined direction. Part (ii) is first LC resonator LC1 configured by capacitively coupling meander-shaped part 21 of first radiating element 10 and U-shaped part 11 of second radiating element 20. Part (iii) is a part from feedpoint P to an end of third radiating element 30 on a side opposite to feedpoint P in the predetermined direction. Part (iv) is a part from feedpoint P to the end of the part after where U-shaped part 11 of first radiating element 10 turns back on a side closer to feedpoint P. Part (v) is second LC resonator LC2 configured by capacitively coupling meander-shaped part 31 of third radiating element 30 and first radiating element 10. This enables antenna device 1 to be compatible with a plurality of frequencies and to be operable in multiband.

At this time, by adjusting the length of slit 13 from the U-shaped open end in a predetermined direction, the resonance frequency of part (iv) can be adjusted to a desired frequency while a fluctuation of the resonance frequency of part (ii) is suppressed. Further, by adjusting the distance between meander-shaped part 31 of third radiating element 30 and first radiating element 10, the resonance frequency of part (v) can be adjusted to a desired frequency while a fluctuation of the resonance frequency of part (iii) is suppressed.

Then, the first to fifth frequencies can be adjusted to desired frequencies. Specifically, the first frequency can be set to a desired frequency in accordance with the length of second radiating element 20 in the predetermined direction from interlayer connection conductor b. The second frequency can be set to a desired frequency in accordance with the length of first radiating element 10 in the predetermined direction from feedpoint P. The third frequency can be set to a desired frequency in accordance with the length of third radiating element 30 in the predetermined direction from feedpoint P. The fourth frequency can be set to a desired frequency in accordance with the length of slit 13 in the predetermined direction from the U-shaped open end. The fifth frequency can be set to a desired frequency according to the distance between meander-shaped part 31 of third radiating element 30 and first radiating element 10.

Further, third radiating element 30 is provided on second main surface 5B, and thus third radiating element 30 and first radiating element 10 can face each other on first main surface 5A and second main surface 5B of dielectric substrate 5, respectively. This makes it easy to capacitively couple meander-shaped part 31 of third radiating element 30 and first radiating element 10.

Further, antenna device 1, which further includes passive element 43 extending in the predetermined direction, is compatible with the sixth frequency. Specifically, the sixth frequency can be set to a desired frequency in accordance with the length of passive element 43 in the predetermined direction.

Other Exemplary Embodiments

The exemplary embodiment has been described above to exemplify the technique in the present disclosure. For that purpose, the accompanying drawings and the detailed description have been provided.

Consequently, not only components that are essential for solving the problem but also components that are not essential for solving the problem may also be included in the components described in the accompanying drawings and the detailed description in order to exemplify the above technique. Thus, it should not be immediately recognized that the non-essential components are essential because the non-essential components are described in the accompanying drawings and the detailed description.

Further, the exemplary embodiment is for exemplifying the technique in the present disclosure, and thus various changes, replacements, additions, omissions, and the like can be made within the scope of the claims or equivalents thereof. The constituent elements described in the exemplary embodiment can be combined to form a new exemplary embodiment.

For example, third radiating element 30 is provided on second main surface 5B in the exemplary embodiment, but may be provided on first main surface 5A.

Further, for example, antenna device 1 includes passive element 43 in the exemplary embodiment, but does not have to include passive element 43.

For example, the predetermined direction is the x-axis direction (longitudinal direction of dielectric substrate 5) in the exemplary embodiment, but is not limited thereto, and is appropriately determined in accordance with the shape of dielectric substrate 5 and the like.

INDUSTRIAL APPLICABILITY

The present disclosure is applicable to a wireless communication device. Specifically, the present disclosure is applicable to mobile phones, smartphones, tablet terminals, laptop computers, wireless LAN routers, and the like.

REFERENCE MARKS IN THE DRAWINGS

1, 2: antenna device
5: dielectric substrate
5A: first main surface
5B: second main surface
10, 100: first radiating element
11: U-shaped part
12, 22, 32, 101, 102, 202: linear part
13, 130: slit
20, 200: second radiating element
21, 31, 201: meander-shaped part
30, 300: third radiating element
40, 400: antenna GND
41, 401: first part
42, 402: second part
43, 403: passive element
50: wireless communication device
51: housing
52: liquid crystal display
b, b1: interlayer connection conductor
LC1: first LC resonator
LC2: second LC resonator
LC10: LC resonator
P: feedpoint
Q: signal source

The invention claimed is:

1. An antenna device comprising:
a dielectric substrate having a first main surface and a second main surface opposite to the first main surface;
a feedpoint provided at a predetermined position on the dielectric substrate;
a first radiating element provided on the first main surface and extending from the feedpoint in a predetermined direction;
an interlayer connection conductor penetrating the dielectric substrate and connected to the first radiating element;
a second radiating element provided on the second main surface and extending from the interlayer connection conductor in the predetermined direction; and
a third radiating element provided on any one of the first main surface or the second main surface, and extending from the feedpoint in the predetermined direction on a path different from a path of the first radiating element,
wherein the first radiating element has a U-shaped part that goes away from the feedpoint in the predetermined direction, and then turns back and approaches the feedpoint,
the interlayer connection conductor is connected to an end of a part after where the U-shaped part turns back on a side closer to the feedpoint,
the second radiating element has a meander shaped part that overlaps the U-shaped part in plan view of the dielectric substrate, and
the third radiating element has a meander-shaped part that meanders by repeatedly approaching and going away from the first radiating element in the plan view.

2. The antenna device according to claim 1, wherein the third radiating element is provided on the second main surface.

3. The antenna device according to claim 1, wherein
the meander-shaped part of the second radiating element and the U-shaped part are capacitively coupled to configure a first LC resonator,
the meander-shaped part of the third radiating element and the first radiating element are capacitively coupled to configure a second LC resonator,
a part from the feedpoint through the first radiating element and the interlayer connection conductor to an end of the second radiating element on a side opposite to the interlayer connection conductor in the predetermined direction resonates at a first frequency,
the first LC resonator resonates at a second frequency higher than the first frequency,
a part from the feedpoint to an end of the third radiating element on the side opposite to the feedpoint in the predetermined direction resonates at a third frequency higher than the second frequency,
a part from the feedpoint to the end of the part after where the U-shaped part turns back on the side closer to the feedpoint resonates at a fourth frequency higher than the third frequency, and
the second LC resonator resonates at a fifth frequency higher than the fourth frequency.

4. The antenna device according to claim 3, wherein the first frequency is a frequency in accordance with a length of the second radiating element from the interlayer connection conductor in the predetermined direction.

5. The antenna device according to claim 3, wherein the second frequency is a frequency in accordance with a length of the first radiating element from the feedpoint in the predetermined direction.

6. The antenna device according to claim 3, wherein the third frequency is a frequency in accordance with a length of the third radiating element from the feedpoint in the predetermined direction.

7. The antenna device according to claim 3, wherein the fourth frequency is a frequency corresponding to a length of a slit located between parts before and after where the U-shaped part turns back, from a U-shaped open end in the predetermined direction.

8. The antenna device according to claim 3, wherein the fifth frequency is a frequency corresponding to a distance between the meander-shaped part of the third radiating element and the first radiating element.

9. The antenna device according to claim 3, further comprising a passive element that is provided on at least one of the first main surface or the second main surface and is fed with no signal from the feedpoint, wherein the passive element does not overlap any of the first radiating element, the second radiating element, or the third radiating element in the plan view.

10. The antenna device according to claim 9, wherein the passive element resonates at a sixth frequency higher than the third frequency and lower than the fourth frequency.

11. The antenna device according to claim 10, wherein the passive element extends in the predetermined direction, and the sixth frequency is a frequency in accordance with a length of the passive element in the predetermined direction.

* * * * *